US005450706A

United States Patent [19]

Latini

[11] Patent Number: 5,450,706

[45] Date of Patent: Sep. 19, 1995

[54] SINGLE TWIST BUNCH WRAPPING MACHINE

[75] Inventor: Leo Latini, Oak Brook, Ill.

[73] Assignee: Latini Machine Company, Inc., Elmhurst, Ill.

[21] Appl. No.: 64,916

[22] Filed: May 24, 1993

[51] Int. Cl.[6] ..... B65B 11/00; B65B 51/00

[52] U.S. Cl. ..... 53/397; 53/370; 53/594

[58] Field of Search ..... 53/397, 370, 594, 525

[56] References Cited

U.S. PATENT DOCUMENTS

| | | | |
|---|---|---|---|
| 2,278,005 | 3/1942 | Van Veen | 53/594 |
| 2,403,482 | 7/1946 | Cloud | 53/594 X |
| 2,915,861 | 12/1959 | Voullaire | 53/370 |
| 3,131,522 | 5/1964 | Latini et al. | 53/370 |
| 4,907,396 | 3/1990 | McClusky et al. | 53/525 X |
| 5,016,421 | 5/1991 | Ferrero | 53/370 X |
| 5,241,807 | 9/1993 | Quick et al. . | |

FOREIGN PATENT DOCUMENTS

| | | | |
|---|---|---|---|
| 36282 | 9/1981 | European Pat. Off. | 53/594 |

*Primary Examiner*—Linda Johnson
*Attorney, Agent, or Firm*—Patula & Associates

[57] ABSTRACT

A single twist bunch wrapping machine for wrapping lollipops is disclosed. The machine includes an automatic feeding and sorting hopper, a lollipop orienteering plate, a lollipop transfer station, a twist wrapping station, and a paper feed mechanism. The machine economically and precisely wraps a large quantity of lollipops.

31 Claims, 18 Drawing Sheets

380
382
384
375
374
370
390
50
60

SINGLE TWIST BUNCH WRAPPING MACHINE

This invention relates generally to a wrapping machine, and more particularly a lollipop wrapping machine, specifically a single twist bunch wrapping machine incorporating an orienteering plate, a transfer station, and a twist wrapping station.

BACKGROUND OF THE INVENTION

The process of wrapping lollipops has long been a difficult, time-consuming and imperfect process. The process usually begins with a large number of lollipops sitting in a bin in random positions. In order to wrap the lollipops, each lollipop must be separated from the rest, placed in position to receive the wrapping, securely wrapped, and placed in a collection bin. Due to the shape of a lollipop, generally a spherical candy piece having an elongated stick extending therefrom, the separation, positioning, and wrapping processes are extremely difficult. The use of manual labor in an assembly line fashion could achieve the desired result, but such a wrapping process is impractical due to time and financial constraints. Mechanical processes to wrap lollipops present their own problem, again, in separating, positioning, and wrapping the lollipops. As a result, a substantial number of lollipops do not become wrapped or are improperly wrapped.

Accordingly, there is a need for quick and efficient machine for wrapping lollipops, which can effectively separate, position, and wrap lollipops, while drastically reducing the possibility of unwrapped or miswrapped lollipops.

The present invention solves the problems of conventional techniques for wrapping lollipops. The invention efficiently separates, positions, and wraps lollipops in an economical and precise manner, while effectively eliminating the possibility of unwrapped or miswrapped lollipops.

BRIEF SUMMARY OF THE INVENTION

The present invention comprises an automatic feeding and sorting hopper, a lollipop orienteering plate, a lollipop transfer station, a twist wrapping station, and a paper feed mechanism. Unwrapped lollipops are fed from the hopper to the orienteering plate. The orienteering plate positions each lollipop so that it may be properly transferred to the wrapping station. The transfer station then moves the lollipops from the plate to the wrapping station. The paper feed assembly feeds wrapping paper to the wrapping station and the lollipops are precisely wrapped and then discharged to a collection bin.

Accordingly, it is the principle object of the present invention to provide wrapping machine.

It is also an object of the invention to provide a lollipop orienteering plate in a wrapping machine.

It is an additional object of the invention to provide a lollipop transfer station in a wrapping machine.

It is an additional object of the invention to provide a lollipop wrapping station in a wrapping machine.

Numerous other advantages and features of the invention will become readily apparent from the detailed description of the preferred embodiment of the invention, from the claims, and from the accompanying drawings, in which like numerals are employed to designate like parts throughout the same.

BRIEF DESCRIPTION OF THE DRAWINGS

A fuller understanding of the foregoing may be had by reference to the accompanying drawings, wherein.

DETAILED DESCRIPTION OF THE PREFERRED EMBODIMENT OF THE PRESENT INVENTION

Figure 1:
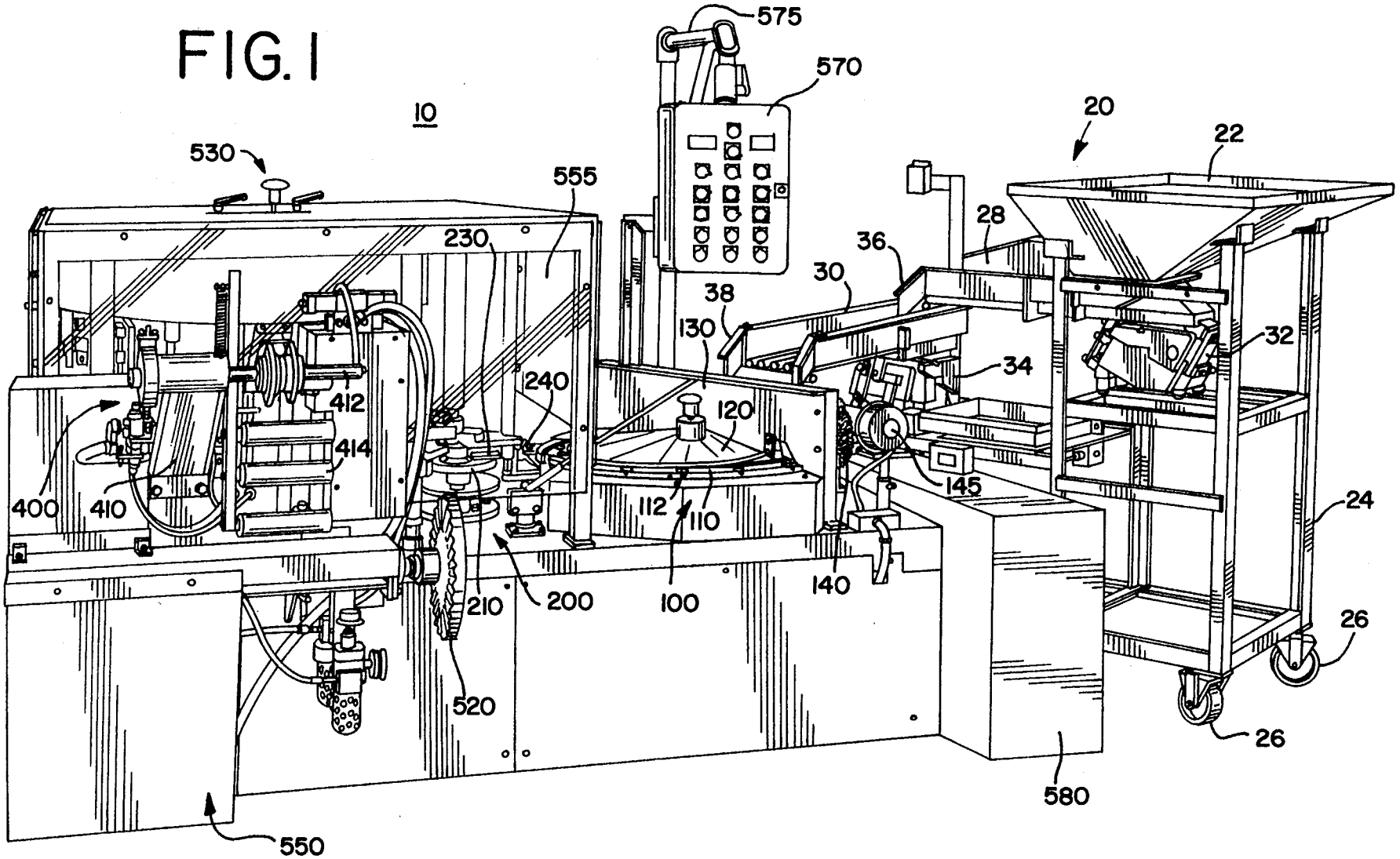
FIG. 1 is a perspective view of the preferred embodiment of the present invention.

While the invention is susceptible of embodiment in many different forms, there is shown in the drawing and will be described herein in detail, a preferred embodiment of the invention. It should be understood, however, that the present disclosure is to be considered an exemplification of the principles of the invention and is not intended to limit the spirit and scope of the invention and/or claims of the embodiment illustrated.

FIGS. 1–24 illustrate generally the present invention 10 comprising an automatic feeding and sorting hopper 20, an orienteering plate 100, a transfer station 200, a wrapping station 300, a paper feed assembly 400, a cam adjustment assembly 530 and a drive assembly 600. The wrapping station 300 comprises a main shaft assembly 310, a stick gripper and elevator assembly 350, a diaphragm assembly 370, and a twister assembly 380.

Referring, more specifically now, to FIG. 1, the present invention 10 is shown. Hopper 20, which holds a plurality of lollipops in random orientation, is positioned at the starting end of the machine, near orienteering plate 100. Hopper 20 is comprised of a bin 22 which holds the lollipops. Bin 22 is supported higher than the orienteering plate 100 by a bin support structure 24. The support structure 24 includes wheels 26 so that hopper 20 can be maneuvered to any desired position near or around orienteering plate 100.

Hopper 20 further comprises a series of ramps or U-shaped channels 28 and 30, along which the lollipops are moved from bin 22 to orienteering plate 100. Vibrating devices 32 and 34 are attached to vibrate the channels 28, 30 so that the lollipops move along the channels 28, 30, which slope downward at a small angle to the horizon. Each channel 28, 30 comprises a bent end 36, 38, respectively, which allow the lollipops to easily exit the ends of the channels. Hopper 20 is illustrated as having two U-shaped channels. It is foreseen that any number of channels placed in any suitable location or arrangement may be used to move the lollipops from bin 22 to orienteering plate 100.

Figure 2:
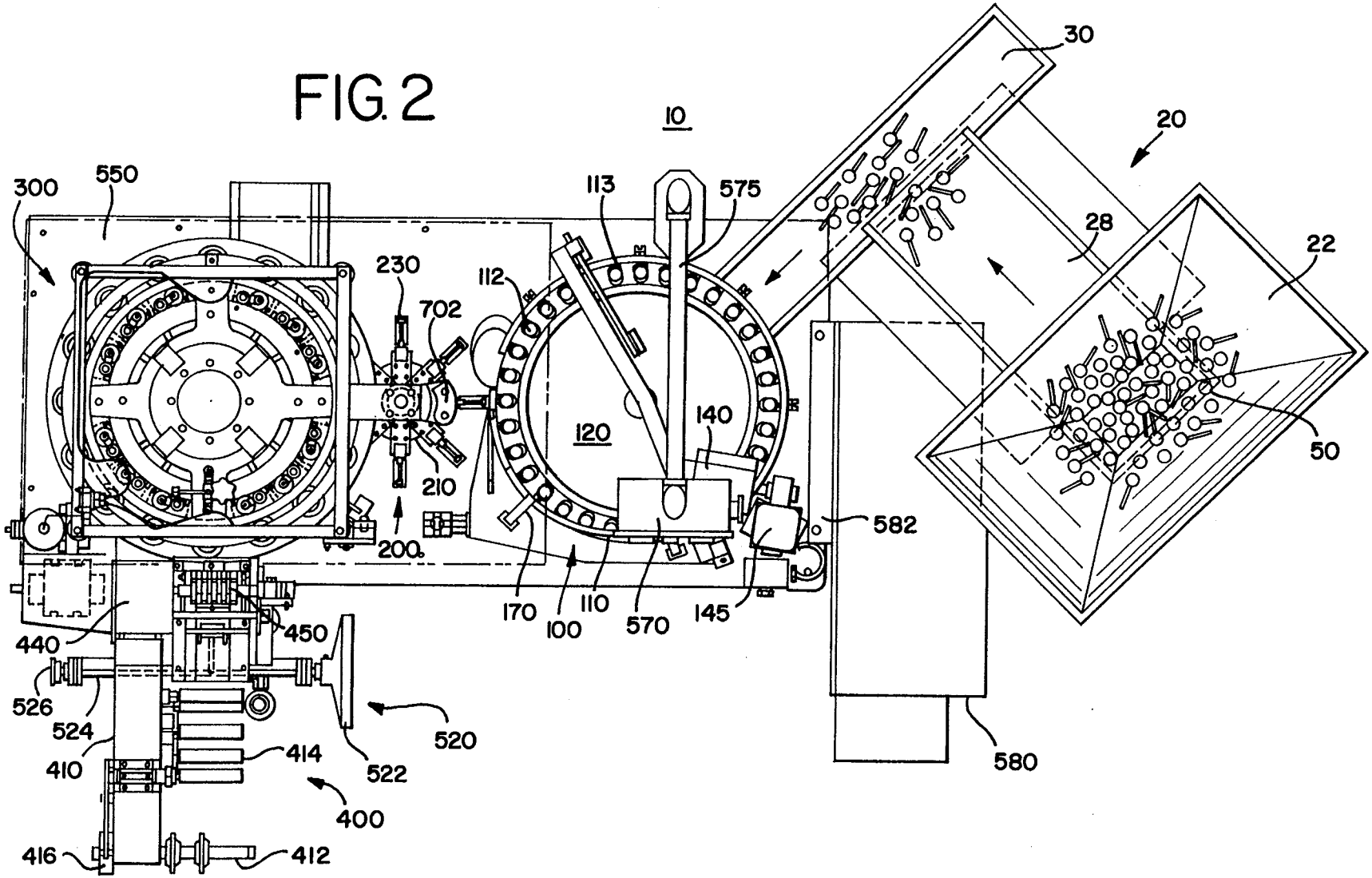
FIG. 2 is a top view of the present invention.
Figure 3:
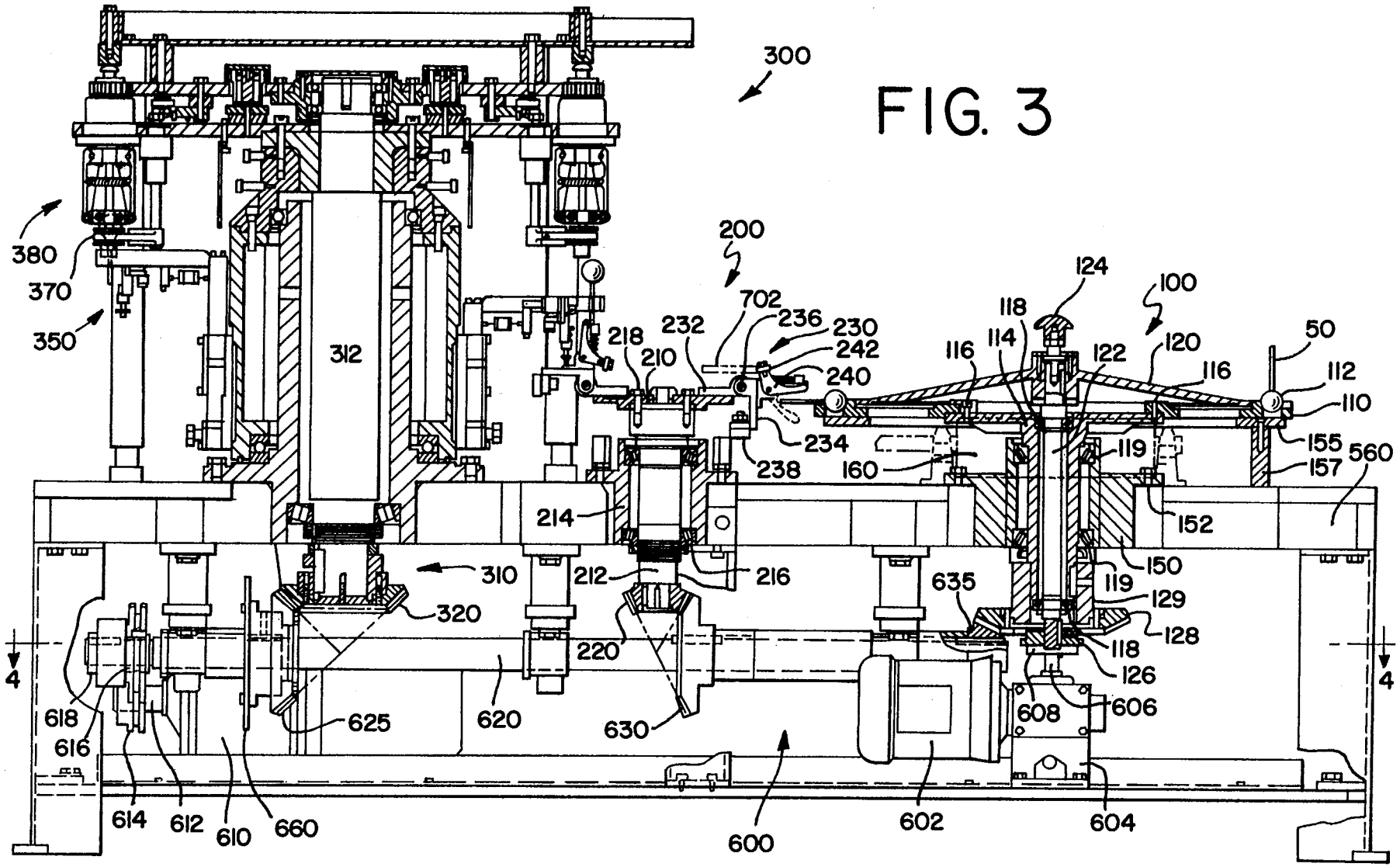
FIG. 3 is a cross-sectional view of the orienteering plate, transfer station, and wrapping station of the present invention.

Lollipops leave bent end 38 and drop to orienteering plate 100 (which is shown in FIG. 3 and will be disclosed in more detail later). As can be seen, orienteering plate 100 comprises a dial plate 110 having dial plate holes 112 and stick grooves 113 (see FIG. 2), a spread plate 120, a plate divider 130, a brush 140 and a brush motor 145. The dial plate 110, spread plate 120, and brush 140 cooperate to position the lollipops into dial plate holes 112 with the lollipop sticks eventually positioned straight out, i.e., perpendicular to a tangent to the dial plate at the location where the dial plate holes are (see FIG. 2). The dial plate 110 rotates to move the lollipops in dial plate holes 112 to the transfer station 200.

Transfer station 200 comprises a stick take over assembly 210. A number of gripper assemblies 230 are mounted to stick take over assembly 210. Each gripper assembly 230 contains a stick take off or gripper 240. Transfer station 200 will be described in more detail later. Transfer station 200 transfers the lollipops from the dial plate 110 to the wrapping station 300 (not shown) for wrapping.

Also shown in FIG. 1 is the paper feed assembly 400. As can be seen, paper feed assembly 400 comprises a paper arm assembly 410 which includes a paper roll sleeve 412 and a plurality of feed rollers 414.

FIG. 1 further depicts hand wheel assembly 520 for manually driving paper feed assembly 400 when desired, for example to initially feed the wrapping paper through assembly 400. Also, a cam adjustment assembly 530 is located on top of machine housing 550. Machine housing 550 includes a clear panel 555 which allows an observer to see the transfer station 200 and the wrapping station 300 inside housing 550. Drive assembly 600 (not shown) is located inside housing 550. A control panel 570 is located outside housing 550 near orienteering plate 100 and is supported by support 575. An electrical box 580 is located next to housing 550.

FIG. 2 is a top view of the present invention 10. Hopper 20 is illustrated as containing a plurality of lollipops 50. Bin 22 holds lollipops 50 in random orientation. The lollipops 50 move from a bottom opening in bin 22 along first channel 28 and second channel 30 to orienteering plate 100. Lollipops 50 fall upon spread plate 120 of orienteering plate 100. Spread plate 120 has a conical surface and rotates counterclockwise. The rotational movement of spread plate 120 spreads lollipops 50 along its surface. At the same time, lollipops 50 slide down along its conical surface to dial plate 110. The heads of the lollipops 50 eventually fall into dial plate holes 112, one per hole. Dial plate 110 rotates clockwise. The lollipops 50 in dial plate holes 112 are brought into contact with brush 140. The rotation of brush 140 by brush motor 145 kicks back any lollipops 50 not in a hole 112, and pushes the sticks of the lollipops 50 in holes 112 inward. As the lollipops in holes 112 pass out from under brush 140, the heads of the lollipops 50 come into contact with a positioning roller 160 (not shown) which moves the sticks of the lollipops into grooves 113, as will be described later. The lollipops 50 in dial plate holes 112 pass through an opening in dial plate divider 130 and move towards transfer station 200. Lollipop sticks still not fully resting in grooves 113 contact a stick guide 170 which biases the sticks into grooves 113. Dial plate divider 130 prevents unoriented lollipops from moving beyond brush 140 or to transfer station 200 which could cause potential problems and delays.

Oriented lollipops are moved to transfer station 200. As can be seen, transfer station 200 comprises a stick takeover plate 210. Attached to stick takeover plate 210 are a plurality of gripper assemblies 230. Eight gripper assemblies 230 are illustrated. Stick takeover plate 210 rotates in a counterclockwise direction. As plate 210 rotates, gripper assemblies 230 grab the oriented lollipops and lift them from dial plate holes 112. Gripper assemblies 230 are actuated by a cam 702. The lollipops are then moved to wrapping station 300 (which will be described in more detail later).

Figure 4:
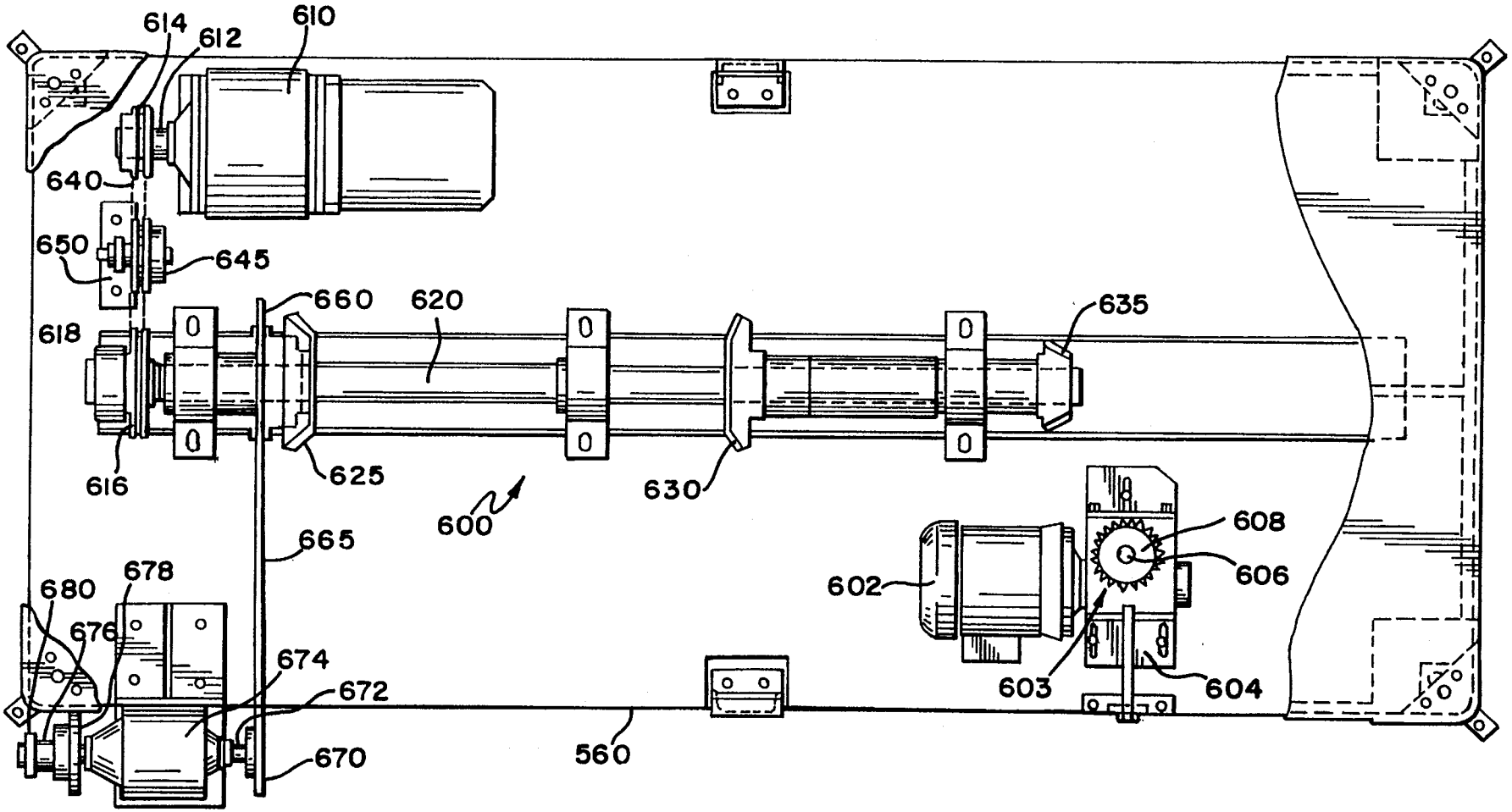
FIG. 4 is a top view of the drive train of the present invention.

Also shown in FIG. 2 is paper feed assembly 400 which feeds wrapping paper to wrapping station 300. Paper feed assembly 400 includes a paper arm assembly 410 having a paper roll sleeve 412, a plurality of rollers 414, and a brake 416, a gear box 440, a roller assembly 450, and a handwheel assembly 520. Handwheel assembly 520 includes a handwheel 522, a shaft 524, and a sprocket 526 which is operatively connected to sprocket 678 (FIG. 4). The lollipops are wrapped by wrapping station 300 and are then discharged to a collection bin (not shown). Control panel 570 along with support 575 are also shown, as is lower part of housing 550. Mounted to housing 550 by a bracket 582 is electrical box 580.

FIG. 3 depicts cross-sectional views of orienteering plate 100, transfer station 200, wrapping station 300, as well as a side view of drive assembly 600. Orienteering plate 100 is shown comprising dial plate 110 having dial plate holes 112. Dial plate 110 is fastened to dial plate shaft 114 by any suitable fasteners 116. Dial plate shaft 114 contains an axial bore therethrough in which spread plate shaft 122 sits. Shaft 122 is mounted for rotational movement within the bore of shaft 114 by bearings 118. Shaft 114 is mounted for rotational movement within a quill 150 by bearings 119. Quill 150 is attached to the housing frame 560 by any suitable fasteners 152.

Spread plate 120 is attached to shaft 122 and is keyed thereto. A palm grip 124 is fastened to the top of shaft 122. Attached to the bottom of shaft 122, and keyed thereto, is a sprocket 126 to provide rotational movement to shaft 122. A bevel gear 128 is suitably fastened to a bevel gear hub 129 which is mounted on and keyed to the bottom of shaft 114 to provide rotational movement thereto. A dial plate support ring 155 is located under dial plate 110 to help stabilize dial plate 110 and assure the lollipops 50 are properly positioned so that the gripper assemblies 230 can grip the sticks of lollipops 50. Support ring 155 is supported under dial plate 110 by a support 157 which is suitably attached to housing frame 560. The lollipop heads rest on and are supported by support ring 155 while in dial plate holes 112. A positioning roller 160 shown in phantom under dial plate 110 positions the sticks of the lollipops into grooves 113.

FIG. 3 further depicts transfer station 200 comprising a stick takeover shaft 212 which is rotatably mounted within a quill 214 by bearings 216. Quill 214 is suitably fastened to housing frame 560. Affixed to the top of shaft 212 by suitable fasteners 218 is stick takeover plate 210. Mounted on and keyed to the bottom of shaft 212 is a bevel gear 220 to provide rotational movement to shaft 212.

Mounted to stick takeover plate 210 are gripper assemblies 230. Gripper assemblies 230 comprise a pivot plate 232 which is suitably fastened to stick takeover plate 210, a base plate 234 pivotably attached to pivot plate 232 by pivot 236, and a stick gripper 240 having a roller 242 mounted at an end thereof. Base plate 234 has a track roller 238 mounted at the end thereof. Cams 702 and 703 (not shown) actuate stick gripper 240 of gripper assemblies 230, as will be described later.

As can be seen in FIG. 3, gripper 240 grabs the stick of lollipop 50 in a horizontal position from dial plate 110 and moves the lollipop to wrapping station 300. During this transfer from dial plate 110 to wrapping station 300, base plate 234 pivots about pivot 236 until the lollipop 50 is in a vertical position, via track roller 238 following a cam 705 (not shown).

Wrapping station 300 is further shown in FIG. 3. Wrapping station 300 comprises a main shaft assembly 310 (which will be described in more detail in reference to FIG. 5). Affixed to the main shaft assembly 310 is a stick gripper and elevator assembly 350 which receives the lollipop from transfer station 200 and raises it into a twister assembly 380, also affixed to main shaft assembly 310. A diaphragm assembly 370 is affixed to main shaft assembly 310 to prevent the lollipop from moving during wrapping in the twister assembly 380.

Drive assembly 600 can be seen mounted in housing frame 560. Drive assembly comprises two motors 602 and 610. It is foreseen however that one motor may be used to drive all components of the present invention. Motor 602 is mounted in positioning block 604 and rotates a shaft 606. A sprocket 608 is mounted on shaft 606 and cooperates with sprocket 126 to rotate spread plate shaft 122. Motor 602 can be any suitable motor of any suitable size. A ⅓ horsepower motor is sufficient to rotate spread plate 120.

Motor 610 is mounted on housing frame 560 and includes a motor shaft 612 having a sprocket 614 mounted thereon. Sprocket 614 of motor 610 cooperates with a sprocket clutch 616 mounted on a main drive shaft 620 to rotate main drive shaft 620. A cam clutch 618 is mounted on main drive shaft 620 next to sprocket clutch 616. Main drive shaft 620 further includes three bevel gears 625, 630, and 635 suitably mounted thereon. Gear 625 cooperates with a bevel gear 320 mounted to main shaft 312 of main shaft assembly 310 to rotate main shaft assembly 310. Gear 630 cooperates with bevel gear 220 to rotate transfer station 200. Gear 635 cooperates with bevel gear 128 to rotate dial plate 110. Motor 610 can be any suitable motor of any suitable size. A 1% horsepower motor is sufficient to rotate main shaft 620. As can be seen, rotation of main shaft 620 simultaneously rotates dial plate 110, transfer station 200 and wrapping station 300. Bevel gears 128, 220, 320, 625, 630, and 635 are appropriately sized and located such that rotation of dial plate 110, transfer station 200, and wrapping station 300 is properly synchronized such that each oriented lollipop 50 on dial plate 110 is picked up by transfer station 200 and subsequently wrapped by wrapping station 300. Therefore, the wrapping process is one continuous motion, wrapping lollipops one after another.

FIG. 4 shows a top view of drive assembly 600 mounted in housing frame 560. Motor 602 having a reducer 603 is shown next to positioning block 604. Sprocket 608 on shaft 606 can also be seen. Motor 610 with shaft 612 and sprocket 614 is shown cooperating with sprocket clutch 616 and cam clutch 618 through a drive chain 640. Between sprocket 614 and sprocket clutch 616 is located an idler assembly 645 including a tensioner bracket 650. Main shaft 620 is shown having bevel gears 625, 630, and 635, and sprocket 660 mounted thereon. Sprocket 660 is operatively connected to a sprocket 670 by a drive chain 665. Sprocket 670 is mounted on a reducer shaft 672 of reducer 674. Mounted to a shaft extension 676 of reducer shaft 672, is a manual drive sprocket 678 and a pulley 680. Sprocket 678 is operatively connected to handwheel assembly 520. Pulley 680 is operatively connected to paper feed drive assembly 490.

Figure 5:
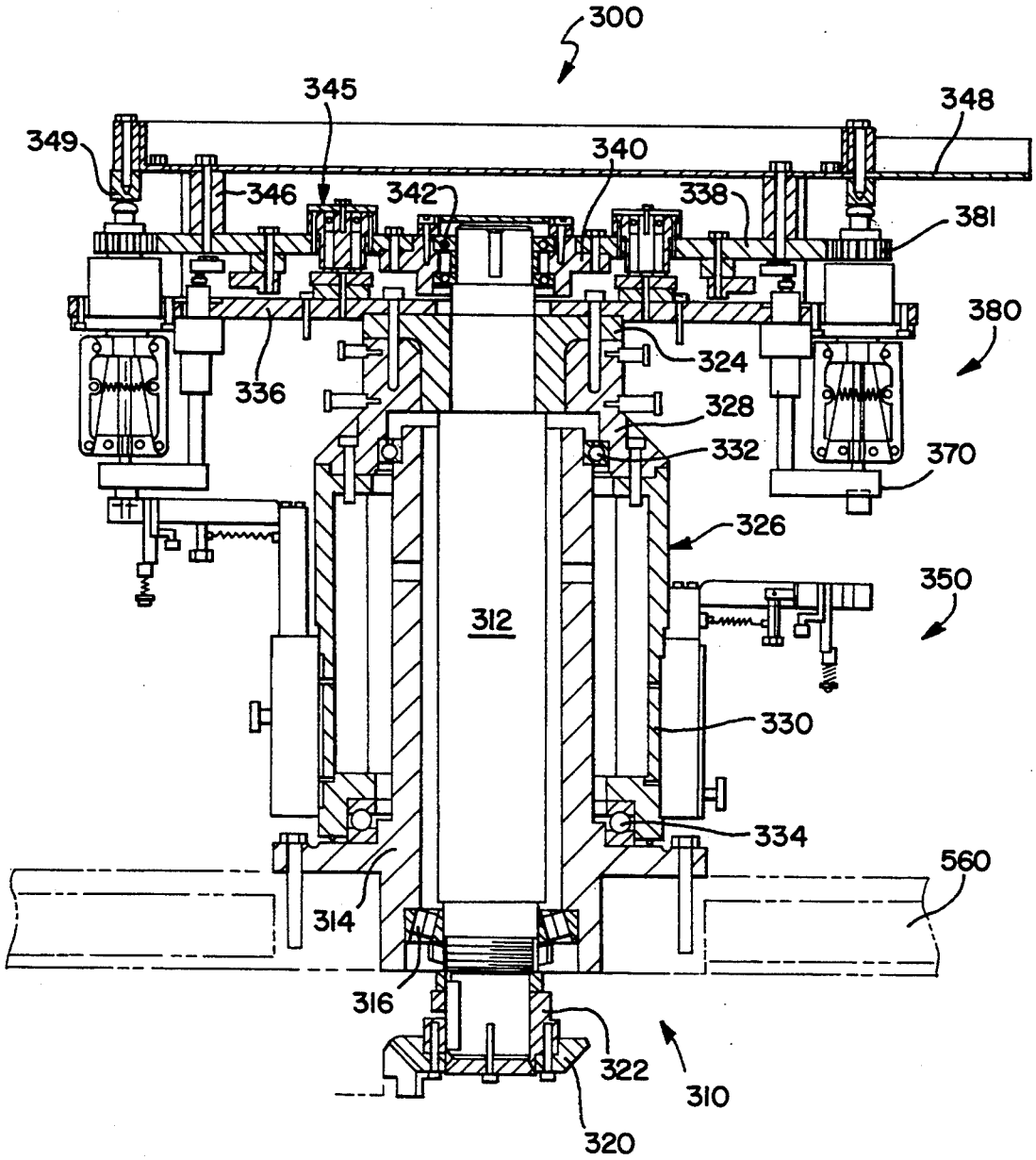
FIG. 5 is a cross-sectional view of the wrapping station of the present invention.

FIG. 5 is a cross-sectional view of wrapping station 300 including main shaft assembly 310. Wrapping station 300 further includes stick gripper and elevator assembly 350, diaphragm assembly 370, and twister assembly 380.

Main shaft assembly 310 of wrapping station 300 includes a main shaft 312. A bevel gear 320 is suitably attached to a gear hub 322 mounted on and keyed to main shaft 312 to provide rotational movement thereto. Main shaft 312 partially rests inside a console 314 and is rotationally supported therein by bearings 316. Console 314 is affixed to housing frame 560 by suitable fasteners.

A hub member 324 is mounted on and rotates with main shaft 312 above console 314. Securely mounted to hub member 324 is a twister head 326. Twister head 326 is comprised of a top portion 328 and a bottom portion 330. Twister head 326 is rotationally supported around console 314 by bearings 332 and 334. Stick gripper and elevator assembly 350 is mounted on bottom portion 330 of twister head 326 and rotates therewith, around console 314.

Mounted atop hub member 324 by suitable fasteners is a fixation ring 336. Fixation ring 336 rotates in unison with twister head 326. Mounted in fixation ring 336 for rotation therewith are diaphragm assembly 370 and twister assembly 380.

Supported above fixation ring 336 is a twister gear 338. Twister gear 338 is mounted to a hub member 340 which is rotationally supported on main shaft 312 by a pair of bearings 342. Twister gear 338 cooperates with planetary gears 381 of the twister assembly 380 as will be described in more detail later. Twister gear 338 contains carbon brushes 345 mounted therewithin for electrical purposes.

Mounted above twister gear via standoffs 346 is a top frame 348 of wrapping station 300. A cam 349 is mounted on top frame 348 and cooperates with twister assembly 380 as will be more fully described later.

Figure 6:
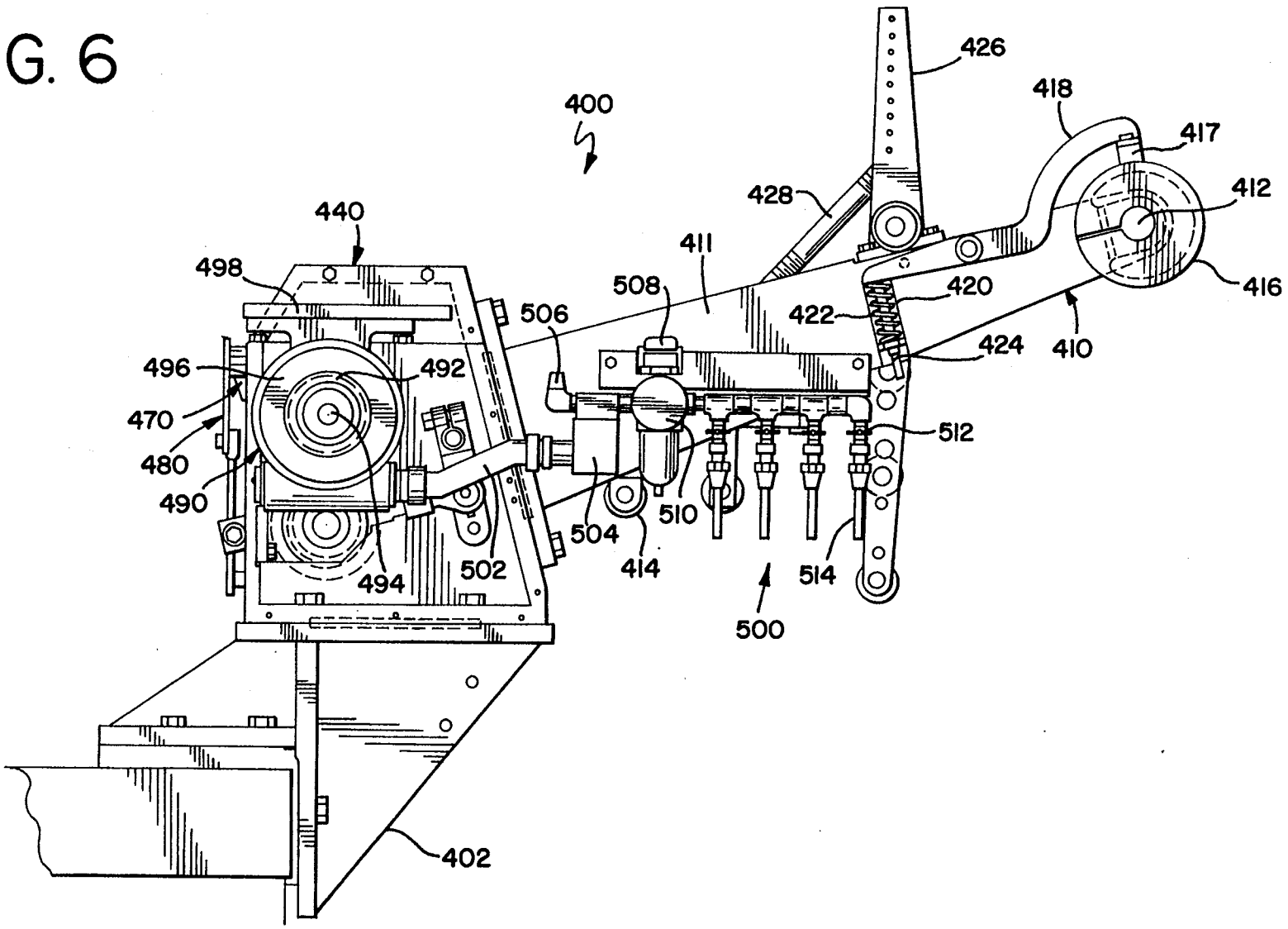
FIG. 6 is a side view of the paper feed assembly of the present invention.

Referring now to FIG. 6, the paper feed assembly 400 of the present invention 10 is shown. Paper feed assembly 400 includes a base 402, a paper arm assembly 410, a gear box 440, a roller assembly 450 (not shown), a paper transfer plate assembly 470, a knife assembly 480, a paper feed drive assembly 490, and a handwheel assembly 520 (not shown).

As can be seen in FIG. 6, paper arm assembly 410 includes paper arm 411, paper roll sleeve 412, feed rollers 414, a brake 416, a brake pad 417, a brake arm 418, and a compression spring 420 in a spring holder 422 and held therein by a spring pin 424. Paper arm assembly 410 further includes a paper feed arm 426 mounted to paper arm 411 and connected therewith by extension spring 428. Paper arm 411 is securely mounted to gear box 440.

FIG. 6 further shows paper feed drive assembly 490 including a pulley 492 mounted on a shaft 494 and in cooperation with a clutch brake 496. Clutch brake 496 is mounted to a support 498.

Paper feed assembly 400 further includes control and monitoring mechanisms 500 including conduit 502, solenoid valve 504, male elbow 506, filter regulator 508, pressure gauge 510, and a plurality of air cocks 512 having thermoplastic tubing 514 connected thereto.

Figure 7:
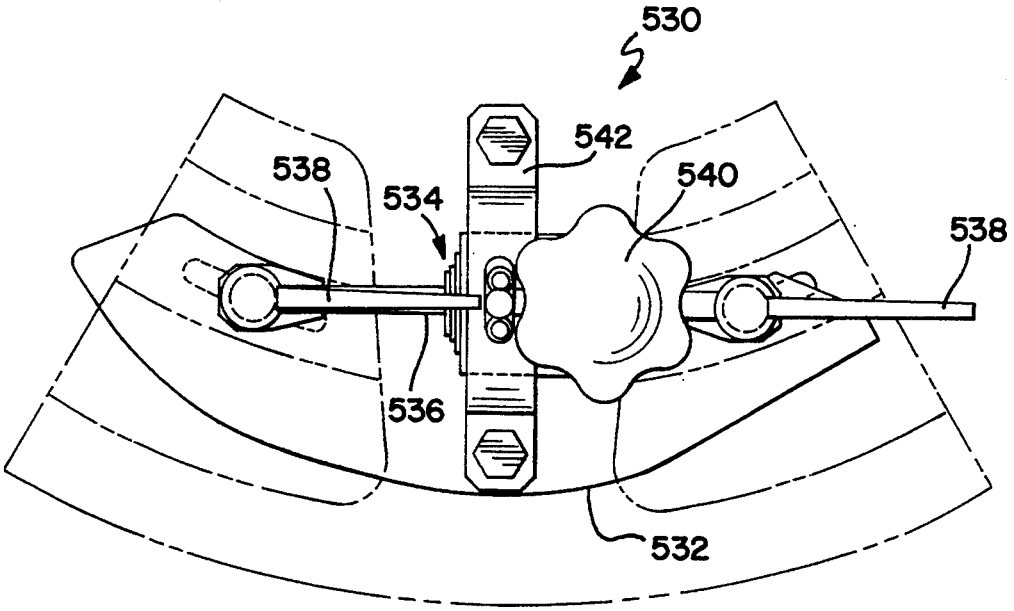
FIG. 7 is a top view of the cam adjustment assembly of the present invention.

FIG. 7 is a top view of cam adjustment assembly 530. Cam adjustment assembly 530 includes cam 532. Cam 532 is adjusted by a cam adjuster 534. Cam adjuster 534 includes cam connector 536, adjustable handles 538, cam adjuster palm grip 540, and mounting block 542.

Figure 8:
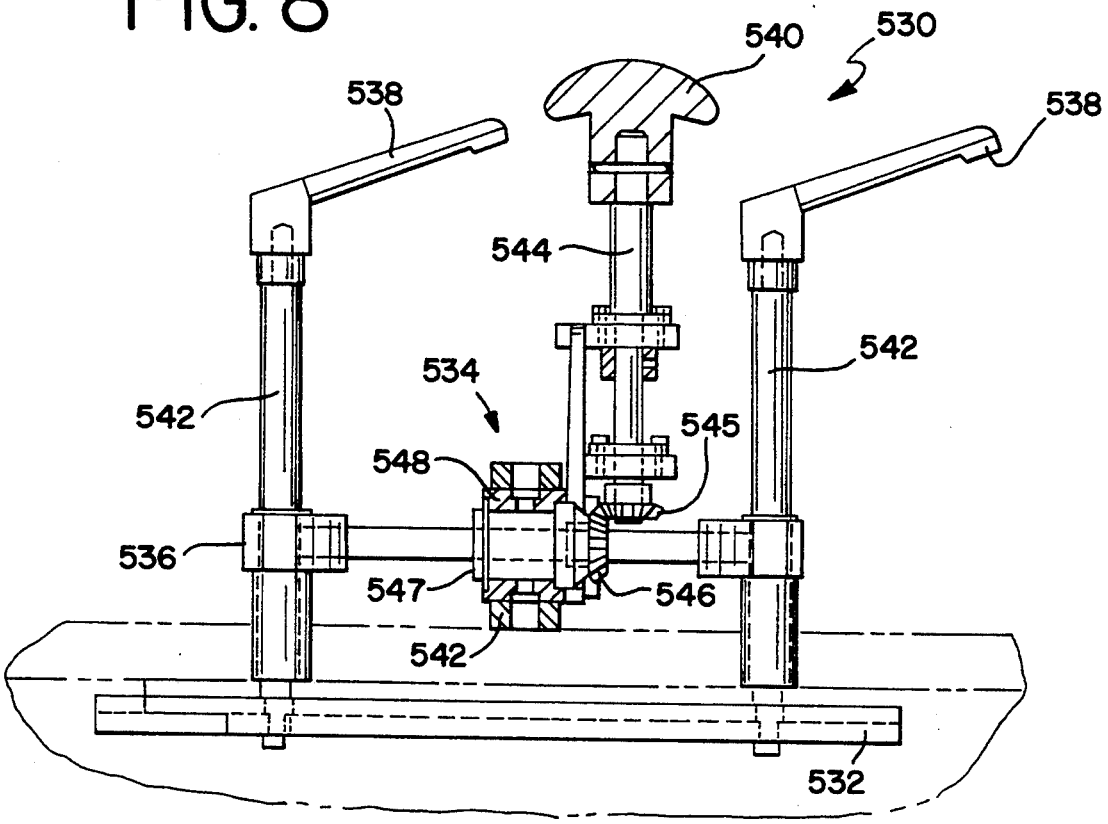
FIG. 8 is a side view of the cam adjustment assembly of the present invention.

FIG. 8 shows a side view of cam adjustment assembly 530 including cam 532, cam adjuster 534, cam connector 536, adjustable handles 538, palm grip 540 and mounting block 542. Adjustable handles 538 are mounted atop system lock shafts 542. Cam connector 536 spans from one shaft 542 to the other. Palm grip 540 is mounted atop cam adjuster shaft 544. Mounted at the end of shaft 544 is a miter gear 545. Miter gear 545 is cooperatively associated with gear 546 and gear nut 547. Gear nut 547 is located in a retaining ring 548 mounted in mounting block 542. Cam 532 can be selectively positioned by cam adjustment assembly 530 such that roller **376*a* of diaphragm assembly 370 (see FIGS. 12 and 13) contacts cam 532** at a desired time.

Figures 9A, 9B, 9C, 9D, 9E, 9F, 9G, 9H:
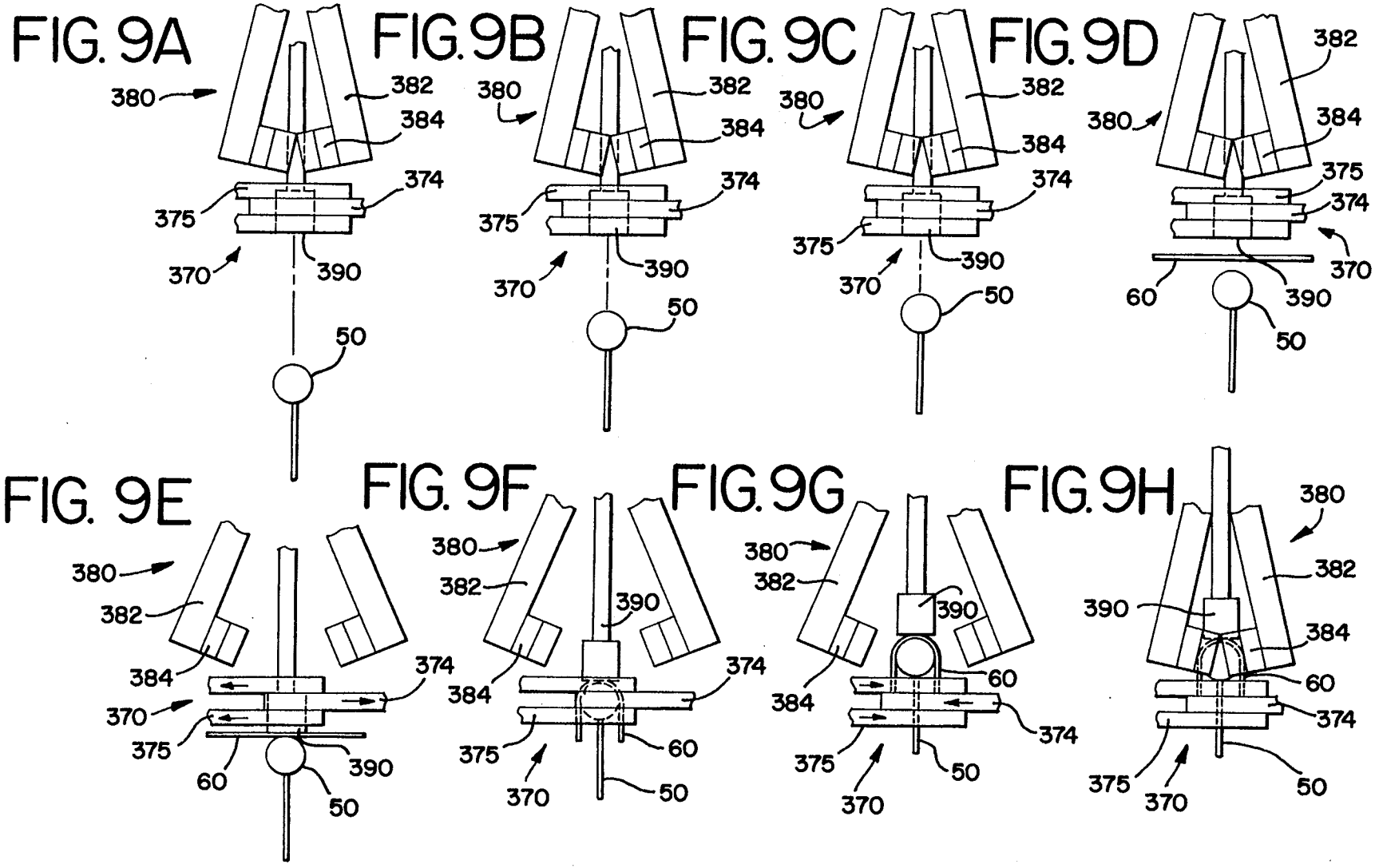
FIG. 9A–9P are schematic views of different stages of the twister of the present invention.
Figures 9I, 9J, 9K, 9L, 9M, 9N, 9O, 9P:
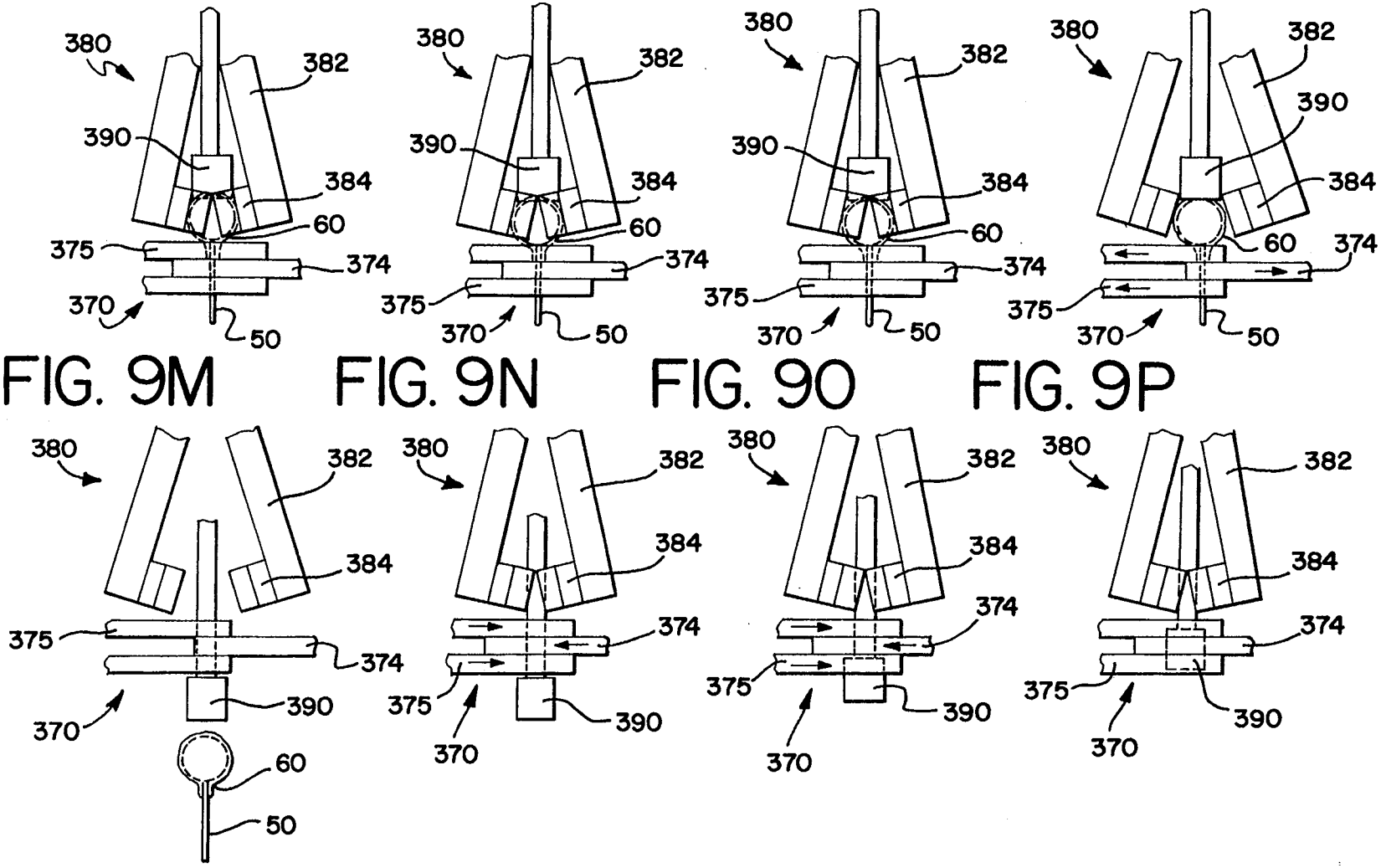

FIGS. 9A–9P illustrate, step-by-step, how diaphragm assembly 370 and twister assembly 380 cooperate to wrap lollipop 50. As can be seen in FIGS. 9A–9P, twister assembly 380 comprises two twistfingers 382 each having a gripper 384. Twister assembly 380 further includes a plunger 390. Diaphragm assembly 370 includes an inside diaphragm claw 374 and an outside diaphragm claw 375.

FIG. 9A shows lollipop 50 positioned under diaphragm assembly 370 and twister assembly 380. Twister fingers 382 are constantly rotating clockwise. Diaphragm assembly 370 is closed around plunger 390.

FIGS. 9B and 9C illustrate lollipop 50 moving upward towards diaphragm assembly 370 and twister assembly 380.

FIG. 9D shows paper 60 being fed over lollipop 50 and under diaphragm assembly 370 as lollipop 50 nears diaphragm assembly 370.

FIG. 9E shows lollipop 50 continuing to move up and contacting paper 60. At the same time, plunger 390 drops down as claws 374 and 375 of diaphragm 370 swing open. Plunger 390 traps paper 60 between plunger 390 and lollipop 50. At this stage in the wrapping process, twister fingers 382 open.

FIG. 9F shows plunger 390 and lollipop 50 moving up into twister assembly 380 through an opened diaphragm 370. As lollipop 50 moves through diaphragm 370, paper 60 forms around lollipop 50.

FIG. 9G shows plunger 390 and lollipop 50 moved completely through diaphragm 370 into a wrapping position. Claws 374 and 375 of diaphragm 370 begin to close.

FIG. 9H shows twister fingers 382 and grippers 384 closing around paper 60 and the lollipop head. The diaphragm assembly 370 completely closes around paper 60 and the lollipop stick.

In FIG. 9I, twister fingers 382 rotate both the lollipop head and the paper surrounding the lollipop head. At the same time, claws 374 and 375 of diaphragm assembly 370 securely hold the paper at the point surrounding the lollipop stick. Therefore, the paper 60 receives one complete twist around lollipop 50, resulting in a spiralling pattern in the paper where the lollipop stick meets the lollipop head. While the present invention is a single twist bunch wrapping machine, it could be made to put multiple twists in the paper. The diaphragm assembly 370 then heat seals the twist formed in paper 60, thereby securely wrapping lollipop 50. FIGS. 9J and 9K further illustrate the wrapping process of FIG. 9I.

FIG. 9L illustrates the beginning of the discharge of a wrapped lollipop from the wrapping station. Once a lollipop 50 is wrapped, twister fingers 382 and diaphragm 370 open. Plunger 390 begins to drop, pushing the wrapped lollipop downward.

FIG. 9M illustrates plunger 390 pushing lollipop 50 completely clear of diaphragm 370. Lollipop 50 then falls into a storage bin.

FIG. 9N illustrates the resetting of twister assembly 380 and diaphragm 370. Plunger 390 begins to rise into diaphragm 370. Claws 374 and 375 of diaphragm 370 begins to close around plunger 390. Twister fingers 382 close.

FIG. 90 further illustrates plunger 390 rising into diaphragm 370 as diaphragm 370 closes around plunger 390.

FIG. 9P shows twister assembly 380 and diaphragm assembly 370 reset into the position of FIG. 9A, ready to wrap another lollipop.

Figure 10:
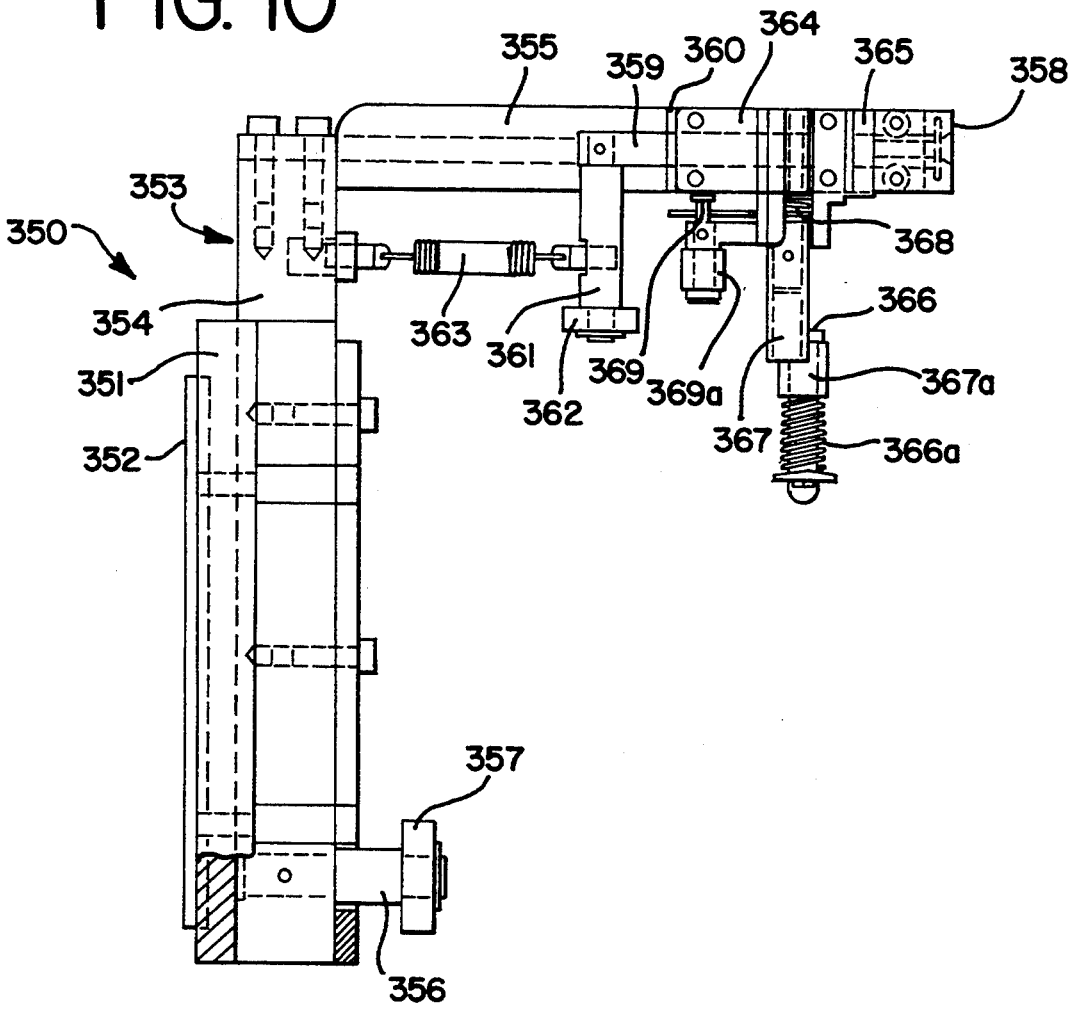
FIG. 10 is a side view of the stick gripper and elevator assembly of the present invention.

FIG. 10 is a side view of the stick gripper and elevator assembly 350. As can be seen, stick gripper and elevator assembly 350 comprises a guide body 351 which is mounted to twister head bottom 330 (FIG. 5) by key 352. A height adjuster arm assembly 353 is slidably mounted in guide body 351. Height adjuster arm assembly 353 includes a height adjuster shaft 354 and a gripper arm 355. A pin 356 having a roller 357 mounted thereon at an end thereof, is mounted to a lower portion of adjuster shaft 354. Roller 357 rides along a cam 706 (not shown) to adjust the height of the assembly 353.

Gripper arm 355 includes a stick gripper 358 and a stick supporter 366. Stick gripper 358 is mounted on the far end of a glider 359 which is slidably mounted in a glider body 360. Mounted on the near end of glider 359 is a pin 361. Rotatably mounted to the lower end of pin 361 is a roller 362. Roller 362 cooperates with cams 708 and 710 (FIGS. 21 and 22) to selectively open stick gripper 358. An extension spring 363 connects pin 361 to adjuster shaft 354 to bias stick gripper 358 in a closed position. A stick fixing plate 364 is mounted to glider body 360. Stick fixing plate 364 contains a flange 365 against which stick gripper 358 holds a lollipop stick.

Stick supporter 366 is mounted to an arm 367*a* of a rotation pin 367. Rotation pin 367 contains a torsion spring 368 operatively connected to a stick supporter pin 369. Stick supporter pin 369 has a roller 369*a* mounted on a lower end thereof. Roller 369*a* cooperates with a cam 712 (not shown) such that torsion spring 368 in pin 369 rotates rotation pin 367 and stick supporter 366 so that stick supporter 366 is positioned under the lollipop stick during the wrapping position.

Figure 11:
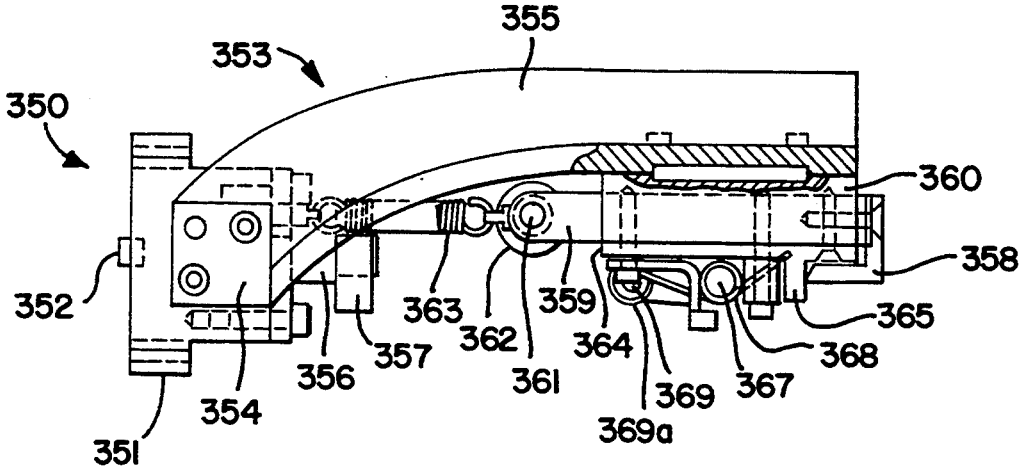
FIG. 11 is a top view of the stick gripper and elevator assembly of the present invention.

FIG. 11 shows a top view of the stick gripper and elevator assembly 350. Adjuster arm assembly 353 is slidably mounted in guide body 351 having key 352. Adjuster arm assembly 353 comprises adjuster shaft 354 and gripper arm 355. Adjuster shaft 354 has a roller 357 attached at a lower end by a pin 356. Gripper arm 355 is shown having glider body 360 keyed thereto. Glider body 360 slidably receives a glider 359. Glider 359 has a stick gripper 358 mounted at a far end thereof. A pin 361, mounted at the near end of glider 359, contains a roller 362. An extension spring 363 biases gripper 358 on glider 359 in a closed position. Gripper 358 holds a lollipop stick against a flange 365 of a stick fixing plate 364 which is mounted to glider body 360. Also seen in FIG. 11 is rotation pin 367, torsion spring 368, stick support pin 369 and roller 369*a*.

Figure 12:
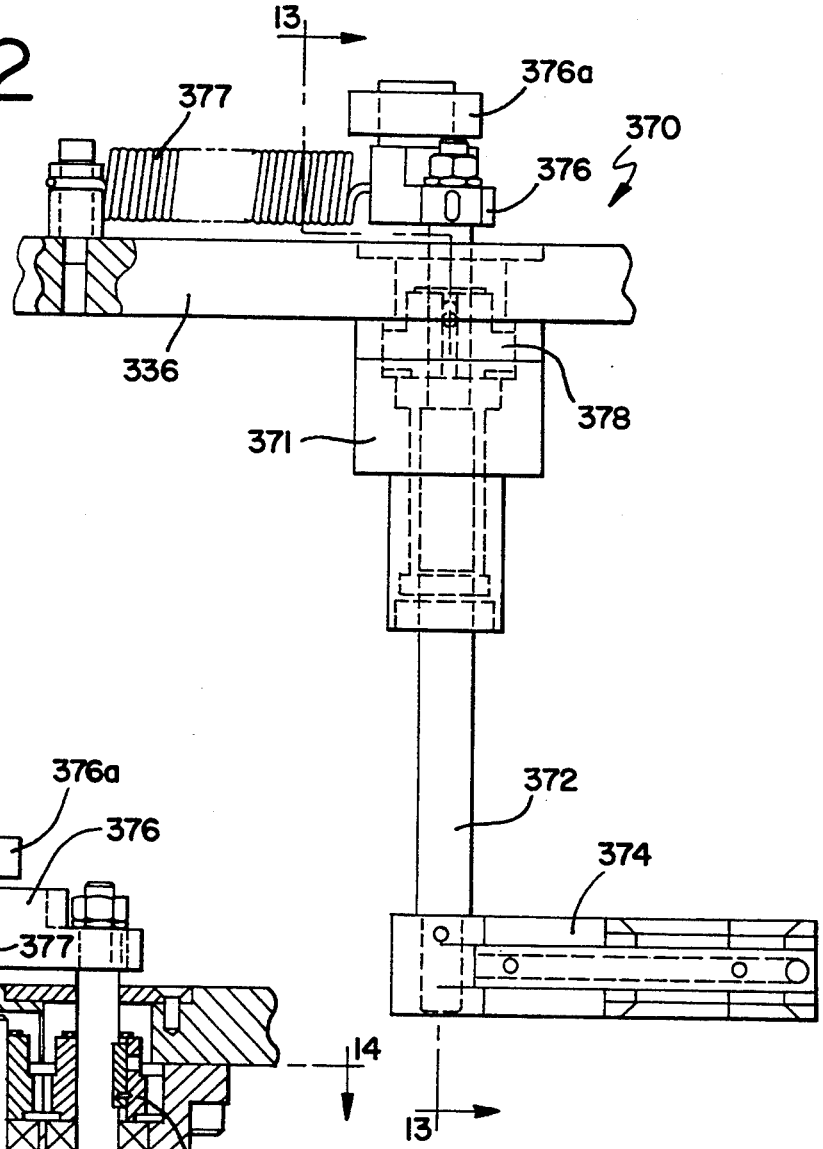
FIG. 12 is a side view of the diaphragm assembly of the present invention.

Diaphragm assembly 370 will be described in detail next with reference to FIG. 12–14. FIG. 12 shows a side view of diaphragm assembly 370. Diaphragm assembly 370 comprises a diaphragm drive body 371 securely fastened to fixation ring 336 of main shaft assembly 310. Rotationally mounted in diaphragm drive body 371 and extending therefrom are diaphragm shafts 372 and 373 (not shown). Attached to the bottom of shafts 372 and 373, respectively, are inside diaphragm claw 374 and outside diaphragm claw 375 (not shown).

Diaphragm shaft 372 extends upward through fixation ring 336. Mounted to the top of shaft 372 is a diaphragm moving arm 376. A roller 376*a* is rotationally mounted atop moving arm 376 and cooperates with cam 532 of cam adjustment assembly 530 to move arm 376 which rotates shaft 372 to open diaphragm 370. An extension spring 377 is operatively connected to moving arm 376 to bias diaphragm assembly 370 in a closed position. Rotation of shaft 372 causes inside diaphragm claw 374 to swing open, away from outside diaphragm claw 375. At the same time, a gear 378 mounted to shaft 372 inside drive body 371 cooperates with a gear 379 (not shown) on shaft 373 to provide rotational movement to shaft 373. Rotation of shaft 373 causes outside diaphragm claw 375 to swing open, away from inside diaphragm shaft 374.

Figure 13:
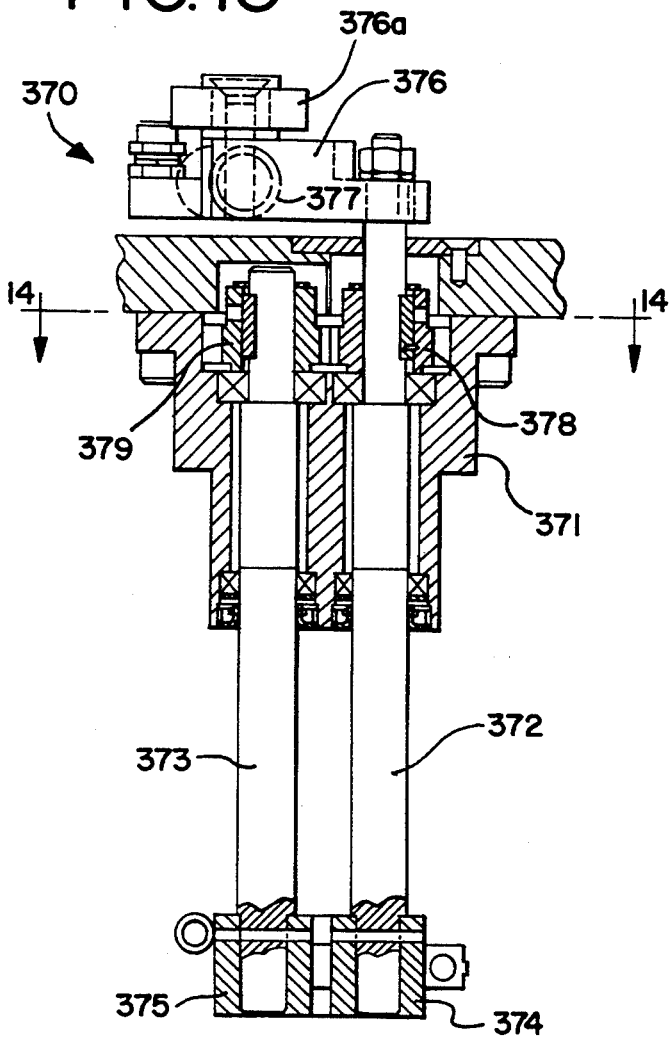
FIG. 13 is a cross-sectional view of the diaphragm assembly of the present invention taken along line 13—13 of FIG. 12.

FIG. 13 shows a cross-sectional view of FIG. 12 taken along line 13—13 in FIG. 12. As can be seen, diaphragm drive body 371 of diaphragm assembly 370 is suitably attached to fixation ring 336. Diaphragm shafts 372 and 373 are rotationally mounted in drive body 371. Shafts 372 and 373 have inside diaphragm claw 374 and outside diaphragm claw 375 mounted respectively thereon. Shaft 372 extends through fixation ring 336 and has a diaphragm moving arm 376 mounted thereon. A roller 376*a* mounted atop arm 376 provides movement of the arm 376 which in turn rotates shaft 372. Rotation of shaft 372 rotates a gear 378 mounted thereon, which cooperates with a gear 379 to simultaneously rotate shaft 373. An extension spring 377 biases moving arm 376 and diaphragm assembly 370 into a closed position.

Figure 14:
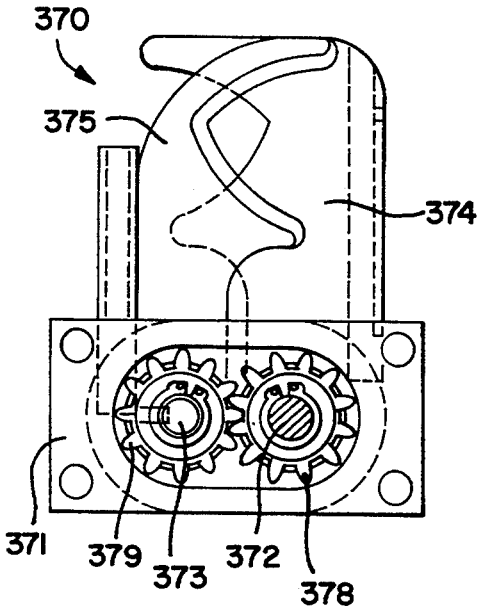
FIG. 14 is a top view of the diaphragm assembly of the present invention along line 14—14 of FIG. 13.

FIG. 14 is a top view of diaphragm assembly 370 taken along line 14—14 of FIG. 13. Diaphragm drive body 371 is shown containing gears 378 and 379 mounted on shafts 372 and 373, respectively. Claws 374 and 375 are mounted on shafts 372 and 373 respectively. Inside diaphragm claw 374 is single pronged, while outside diaphragm claw 375 is double pronged. Inside claw 374 is partially received between the two prongs of outside claw 375 to securely grip a lollipop stick (as illustrated in FIG. 9A–9P).

Figure 15:
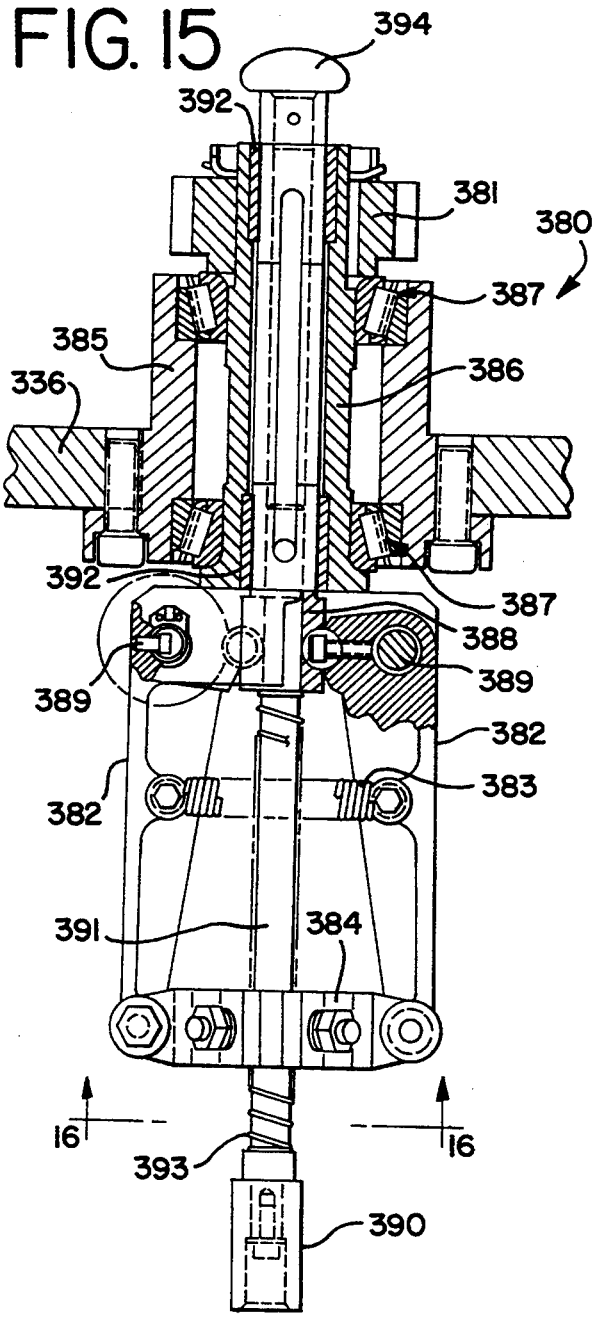
FIG. 15 is a cross-sectional side view of the twister assembly of the present invention.

FIG. 15 is a cross-sectional side view of twister assembly 380. Twister assembly 380 is mounted in fixation ring 336 by twister drive body 385. A twister shaft 386 is rotatably supported in twister drive body 385 by bearings 387. Twister shaft 386 is rotated by planetary gear 381 keyed thereto, which cooperates with twister gear 338 of main shaft assembly 310 to rotate twister assembly 380. Mounted to the bottom of twister shaft 386 are twistfingers 382. Twistfingers 382 contain grippers 384 at a bottom end thereof. An extension spring 383 spans from finger to finger of twistfingers 382. Twistfingers 382 include a twistfinger opener element 388 mounted at an upper end thereof. Each finger of twistfingers 382 is pivotably mounted about a pen 389. Twistfinger opener element 388 cooperates with a plunger shaft 391 of plunger 390 to pivot twistfingers 382 about pens 389. Plunger shaft 391 is mounted in a bore of twister shaft 386 by bushings 392. Plunger shaft 391 has a compression spring 393 therearound at a lower portion thereof which biases plunger 390 upward. Plunger 390 is biased downward by a cam follower 394 mounted on top of plunger shaft 391. Cam follower 394 cooperates with cam 349 and a cam 716 (not shown).

Figure 16:
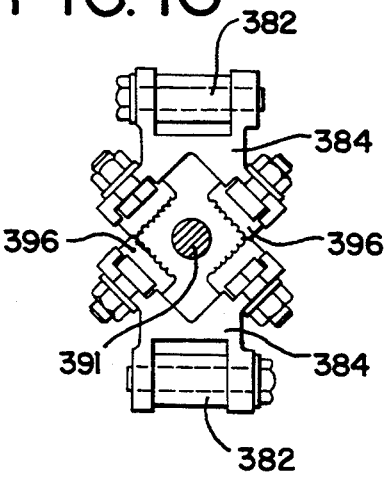
FIG. 16 is a bottom view of the twister assembly of the present invention along line 16—16 of FIG. 15.

Grippers 384 are shown in a bottom view in FIG. 16, taken along line 16—16 of FIG. 15. As can be seen, grippers 384 are suitably mounted to the ends of twistfingers 382. Each gripper 384 contains a plurality of gripper strips 396 suitably fastened to grippers 384. Gripper strips 396 can be of any material having sufficient friction to securely grip and twist a lollipop 50 and the paper 60 therearound. Plunger shaft 391 is shown extending between grippers 384.

Figure 17:
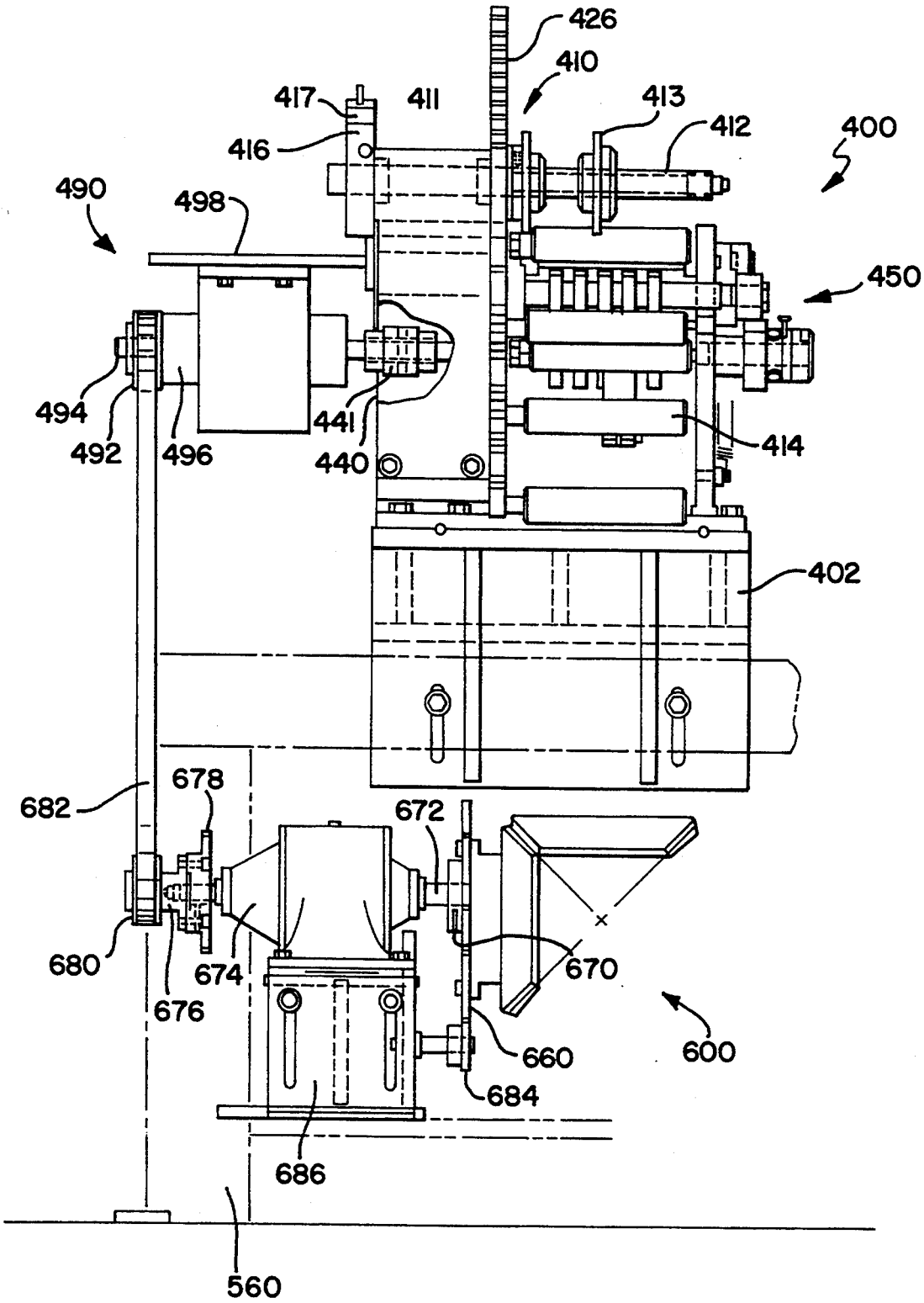
FIG. 17 is a front view of the paper feed assembly of the present invention.

FIG. 17 is a front view of paper feed assembly 400 operatively connected to drive assembly 600. As can be seen, paper feed assembly 400 is mounted on base 402 and includes paper arm assembly 410. Paper arm assembly 410 is shown having paper arm 411, paper roll sleeve 412 with paper roll adapters 413, a plurality of feed rollers 414, a brake 416 and a brake pad 417, and paper feed arm 426. Paper feed assembly 400 further includes a gear box 440 having a coupling 441 for operatively connecting roller assembly 450 to paper feed drive assembly 490.

Paper feed drive assembly 490 is shown having a clutch brake 496 mounted to a support 498. Shaft 494 extends from coupling 441 and through clutch brake 496. A pulley 492 is mounted on an end of shaft 494. Pulley 492 is operatively connected to pulley 680 of drive assembly 600 by a belt 682. Pulley 682 is mounted on an extension 676 of reducer shaft 672 which extends through a reducer 674. A sprocket 670 is mounted on reducer shaft 672 and operatively connects with a sprocket 660 on main drive shaft 620. An idler assembly 684 further connects sprocket 660 with sprocket 670. Reducer 674 is mounted to housing frame 560 by a bracket 686. Shaft extension 676 further includes a manual drive sprocket 678 operatively connected with handwheel assembly 520 (not shown).

Figure 18:
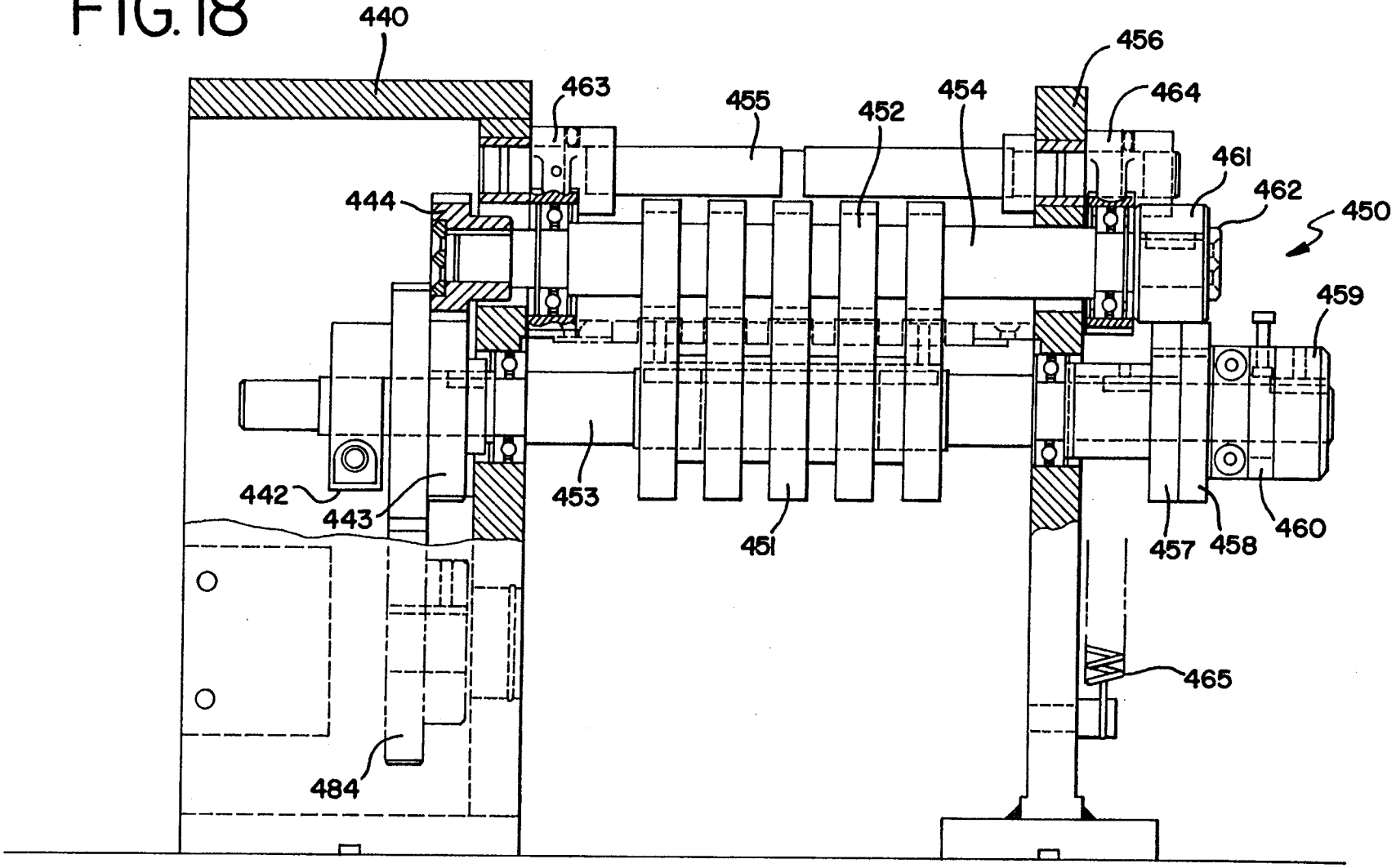
FIG. 18 is a front view of the roller assembly of the paper feed assembly of the present invention.

FIG. 18 is a front view of gear box 440 and roller assembly 450. Roller assembly 450 includes a bottom roller 451 and a top roller 452. Bottom roller 451 has a shaft 453 and top roller 452 has a shaft 454. Roller assembly 450 further includes an arm/brake shaft 455. Shafts 453, 454 and 455 are rotatably mounted in gear box 440 and a mounting flange 456.

Shaft 453 extends into gear box 440 and connects with coupling 441 (not shown). Mounted on shaft 453 in a gear box 440 is an adjustable gear 442 which cooperates with an eccentric gear 484 to operative knife assembly 480 (not shown). A paper drive gear 443 is also mounted on shaft 453 in gear box 440. Paper drive gear 443 cooperates with a top roller gear 444 to simultaneously rotate shaft 454 when shaft 453 is rotated.

Mounted on shaft 453 on the end extending through mounting flange 456, is a fixed cam 457 and an adjustable cam 458. A collar 459 is mounted on shaft 453 to hold cams 457 and 458 thereon. A marking ring 460 to mark paper length is also mounted on shaft 453 between cams 457, 458 and collar 459. A cam roller 461 is mounted on shaft 454 in cooperation with cams 457 and 458. A cover ring 462 holds cam roller on shaft 454.

Arm/brake shaft 455 is interconnected with top roller shaft 454 by a pair of arm plates 463 and 464. Arm plate 464 includes an extension (not shown) to which an extension spring 465 is connected.

Figure 19:
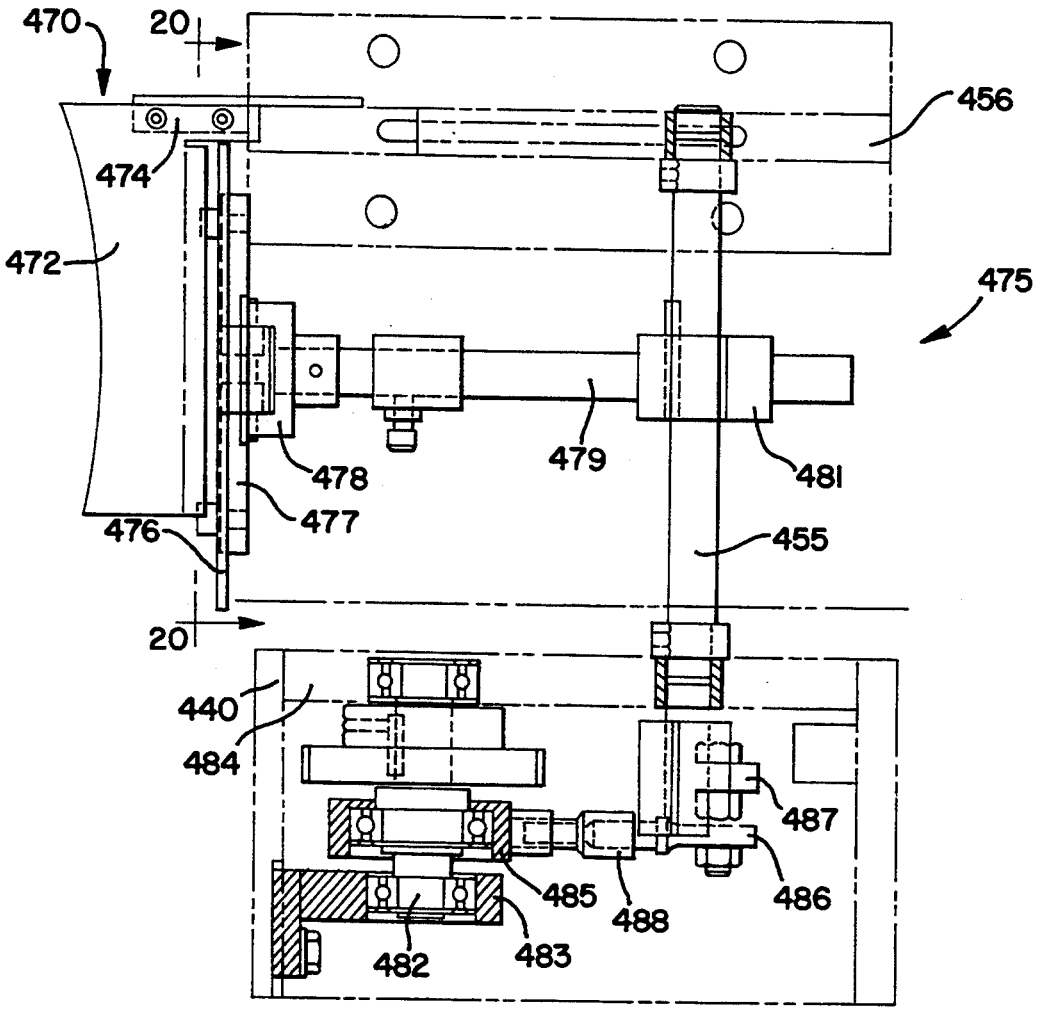
FIG. 19 is a top view of the paper transfer plate and knife assembly of the paper feed assembly of the present invention.

FIG. 19 is a top view of the paper transfer plate assembly 470 and the knife assembly 475 of the present invention. Paper transfer plate assembly 470 comprises a paper guide plate 472. Guide plate 472 is mounted to mounting flange 456 by a guide plate support 474. Guide plate 472 is supported directly in front of knife blade 476 of knife assembly 475.

Knife blade 476 is mounted on a T-shaped knife holder 477. Knife holder 477 is held in place by a fork element 478. Fork element 478 is mounted on an end of a shaft 479. A spring tensioner 480 is mounted on shaft 479 and is connected to the bottom of knife holder 477 by an extension spring (not shown) underneath shaft 479. Shaft 479 further has a knife arm 481 mounted thereto. Knife arm 481 extends upward and is further mounted to arm/brake shaft 455 of roller assembly 450.

Knife assembly 475 also includes a knife eccentric 482 mounted in gear box 440 and a bearing housing 483 located inside gear box 440. Eccentric gear 484 is mounted on eccentric 482. An eccentric housing 485 surrounds eccentric 482. A rod 486 is attached to eccentric housing 485. Mounted to and extending upward from an end of rod 486 is a knife eccentric arm 487. An adjustment screw 488 is mounted on rod 486.

Figure 20:
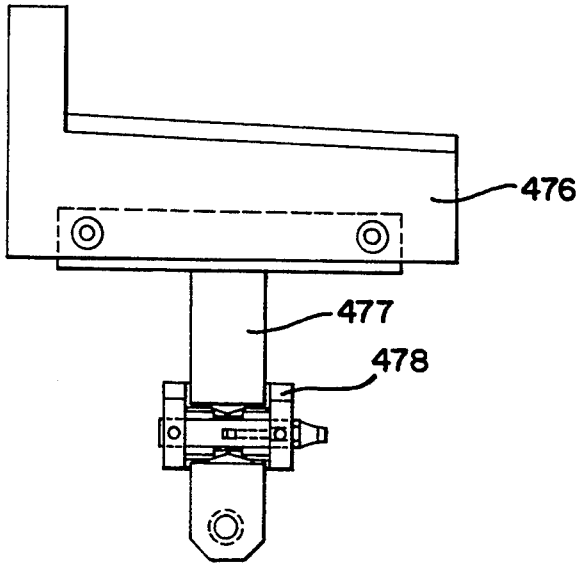
FIG. 20 is a front view of the paper transfer plate and knife assembly of the paper feed assembly of the present invention.

FIG. 20 is a front view of knife blade 476. Knife blade 476 is mounted on T-shaped knife holder 477. Fork element 478 holds knife holder in position.

Figure 21:
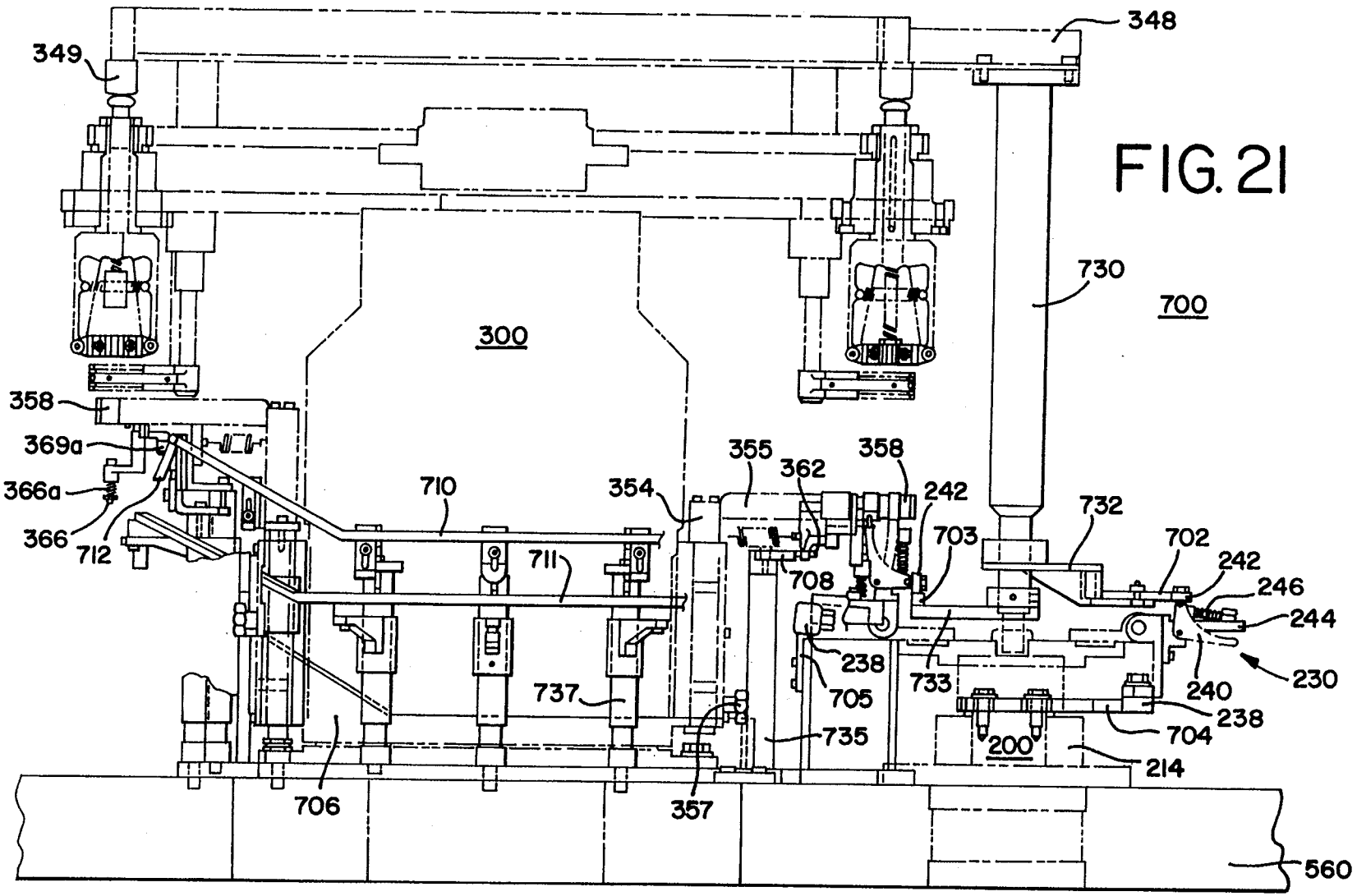
FIG. 21 is a front view of the cam layout of the present invention.

FIG. 21 is a side view of the cam layout 700 of the present invention for use in cooperation with the transfer station 200 and wrapping station 300. Roller 242 of stick gripper 240 contacts a first gripper opening cam 702 to open stick gripper 240. As roller 242 leaves cam 702, a compression spring 246 closes stick gripper 240 and traps a lollipop stick extending from dial plate 110 against a stick gripper block 244. At the same time, roller 238 of gripper assembly 230 contacts a first gripper positioning cam 704 to assure gripper assembly 230 is properly aligned to receive the lollipop stick from dial plate 110. As transfer station 200 rotates, roller 238 contacts a second gripper positioning cam 705 which positions gripper assembly 230 from a horizontal position to a vertical position. When gripper assembly 230 is in a vertical position, roller 242 contacts a second gripper opening cam 703, thereby opening gripper 240 to release the lollipop stick to the stick gripper and elevator assembly 350. Cams 702 and 703 are mounted to a cam shaft 730 by cam holders 732 and 733, respectively. Cam shaft 730 is mounted to and depends from top frame 348. Cam 704 is mounted to quill 214. Cam 705 is mounted to housing frame 560.

As roller 242 contacts cam 703 to open gripper 240, roller 362 of gripper arm 355 of stick gripper and elevator assembly 350 contacts a first gripper opening cam 708 to open stick gripper 358. As roller 362 leaves cam 708, gripper 358 close around the lollipop stick to complete transfer of the lollipop to wrapping station 300. Cam 708 is mounted atop cam support 735 which is mounted to housing frame 560.

As stick gripper and elevator assembly 350 rotates, roller 357 of adjuster shaft 354 follows an elevator cam 706. Elevator cam 706 is mounted to housing frame 560 and has a sloped surface to raise adjuster shaft 354. Similarly, roller 362 of gripper arm 355 follows a second gripper opening cam 710, which opens gripper 358 at an uppermost portion thereof. Likewise, the bottom of stick support 366 follows a stick support cam 711 which biases stick support upward against the force of spring **366*a*, to hold stick support 366 out of the way of gripper assembly 230. Cams 710 and 711 are supported by a plurality of cam supports 737 which are mounted to housing frame 560**.

As cam 710 begins to bias roller 362 of gripper arm 355 outward to open gripper 358, roller **369*a* of stick support pin 369 contacts a stick support positioning cam 712, thereby positioning stick support 366 under the lollipop stick in gripper 358. As roller 369*a* positions stick supporter 366 under gripper 358, stick supporter 366 leaves cam 711** and springs back to a fully opened position.

Cam layout 700 further incudes plunger cam 349 and plunger return cam 716 (not shown). Cam 532 (not shown) of cam adjustment assembly 530 operates diaphragm assembly 370.

Figure 22:
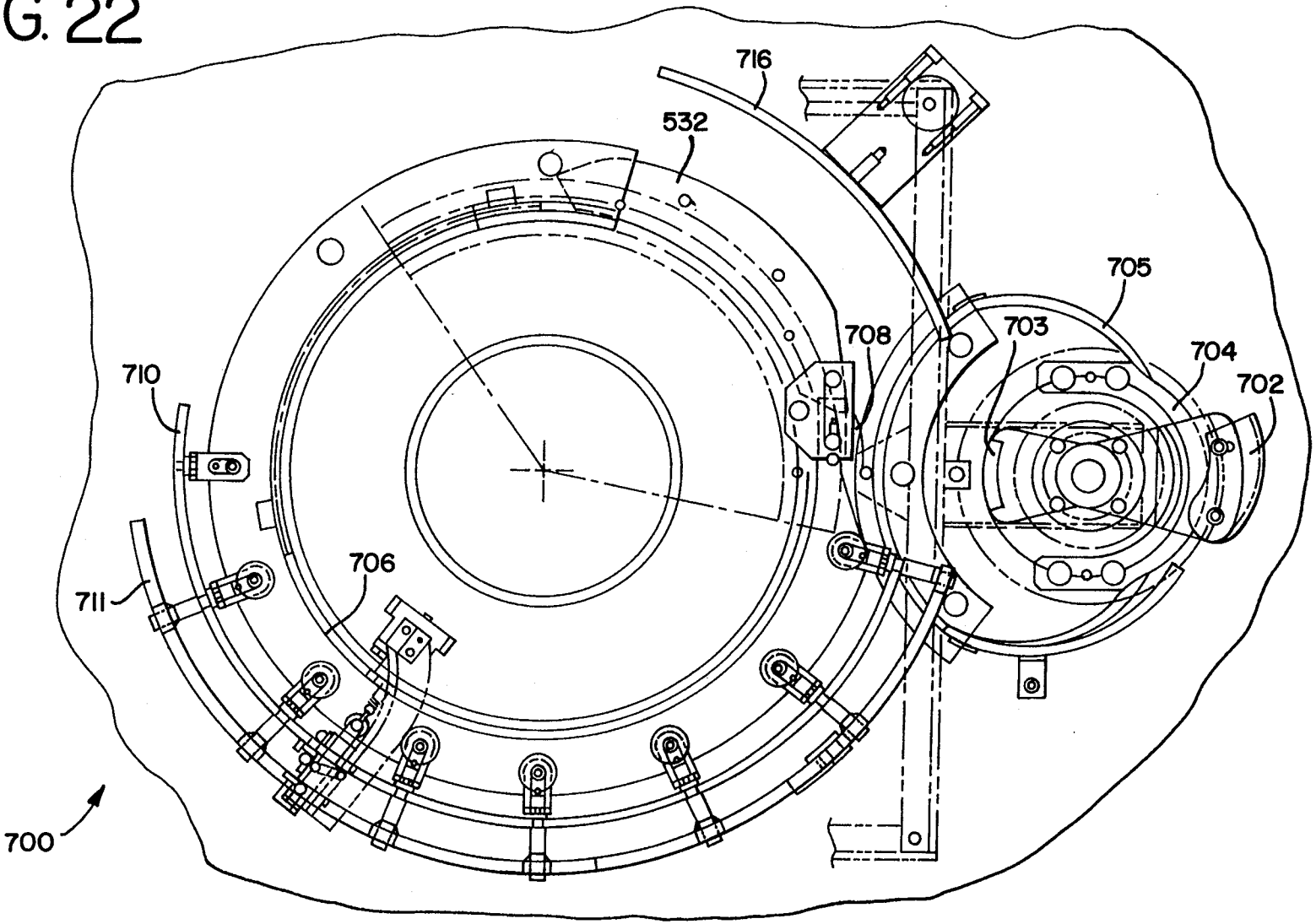
FIG. 22 is a top view of the cam layout of the present invention.

FIG. 22 is a top view of cam layout 700. As can be seen, cam layout 700 includes first gripper opening cam 702, second gripper opening cam 703, first gripper positioning cam 704, and second gripper positioning cam 705. Cams 702–705 cooperate with gripper assembly 230 of transfer station 200.

Cam layout 700 further includes elevator cam 706, first gripper opening cam 708, second gripper opening cam 710, stick support cam 711, and stick support positioning cam 712 (not shown). Cams 706–712 cooperate with stick gripper and elevator assembly 350.

Plunger 390 is actuated by plunger cam 349 (not shown) and plunger return cam 716. Diaphragm assembly 370 is actuated by cam 532. Cam 532 is adjustable by cam adjustment assembly 530 to position cam 532 so that it opens-and closes in sync with stick gripper and elevator assembly 350 and twister assembly 380.

Figure 23:
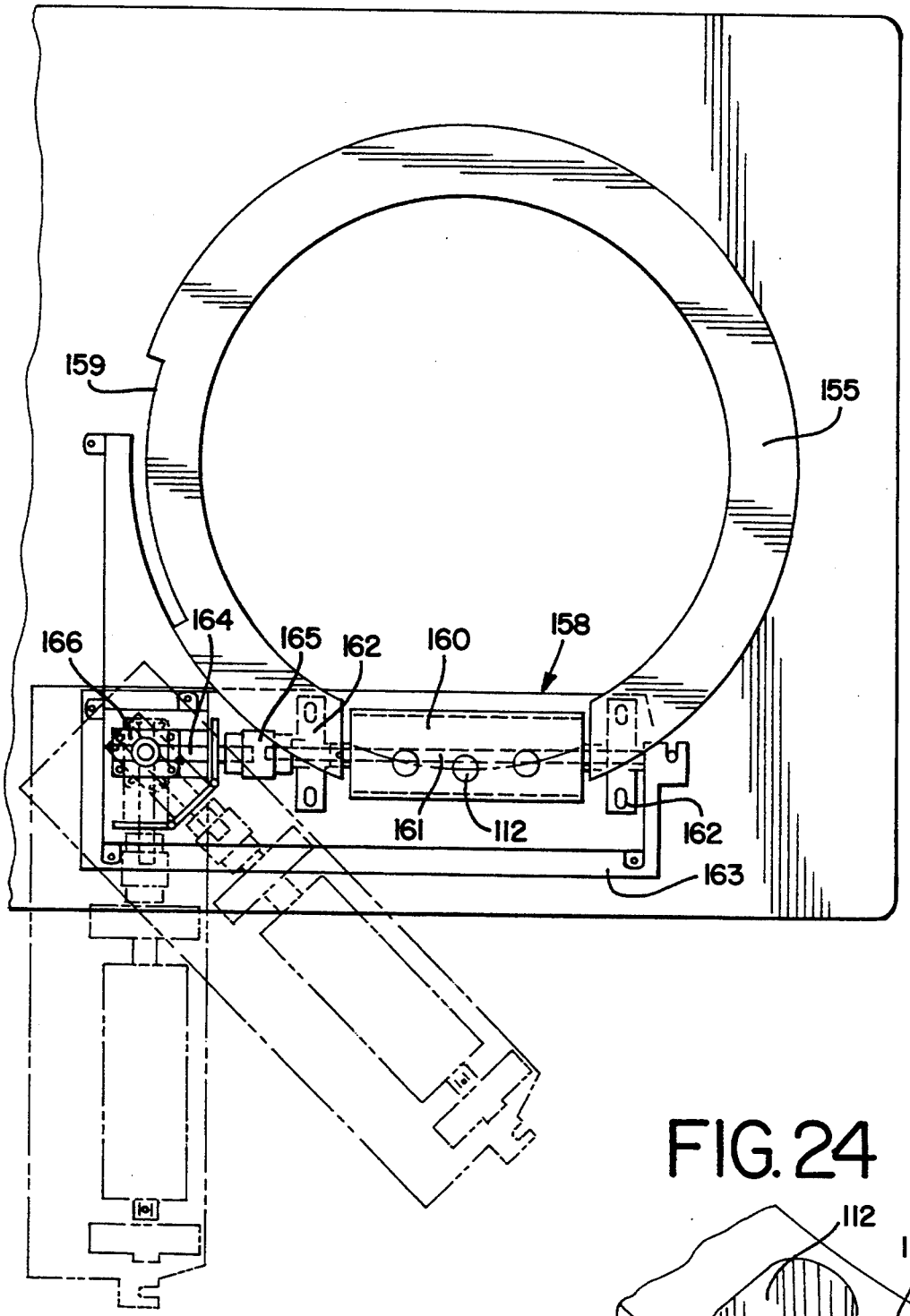
FIG. 23 is a top view of the dial plate support ring and positioning roller of the present invention.

FIG. 23 is a top view of the dial plate support ring 155 and position roller 160. Support ring 155 has an opening 158 in which position roller is located while in use. Support ring 155 further includes a notch 159 through which lollipops in dial plate holes 112 fall through in the unlikely event the lollipops do not get picked up by transfer station 200.

Position roller 160 is mounted on a roller shaft 161. Roller shaft 161 is rotatably mounted in mounting blocks 162. Mounting blocks 162 are fastened to a pivot plate 163 to allow position roller 160 to be pivoted free of support ring 155 for cleaning and maintenance purposes, as illustrated. Roller shaft 161 is connected to a drive shaft 164 by a coupling 165. Drive shaft 164 extends into a gear box 166 in which shaft 164 is operatively connected to drive assembly 600. Drive shaft 164 can be driven by a suitable drive chain connected to main drive shaft 620, or alternately, by a separate motor.

Figure 24:
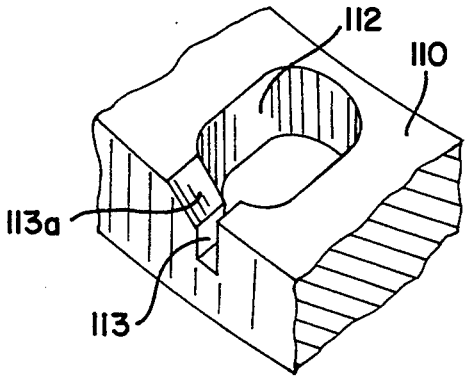
FIG. 24 is a perspective view of a dial plate hole.

FIG. 24 is a perspective view of dial plate hole 112 in dial plate 110 and having stick groove 113. As can be seen, stick groove 113 includes a slanted wall 113*a* to facilitate the entry of lollipop sticks into grooves 113.

In operation, unwrapped lollipops 50 are loaded into bin 22 of hopper 20. Vibrator 32 is energized thereby causing lollipops 50 to move through an opening in bin 22 in a bottom portion thereof, and along first channel 28. Vibrator 32 continues to operate until a sufficient number of lollipops have fallen down sloped end 36 of channel 28 and onto second channel 30. Vibrator 32 can be selectively turned on and off as is necessary. When lollipops reach second channel 30, vibrator 34 is operated to move the lollipops along channel 30, off sloped end 38, and onto orienteering plate 100. Vibrator 34 can be selectively turned on and off as is necessary.

Once on orienteering plate 100, the lollipops on spread plate 120 are moved away from brush 140 due to the counterclockwise movement of plate 120. At the same time, the lollipops are moved towards dial plate 110 due to the conical shape of spread plate 120. Dial plate 110, rotating clockwise, moves the lollipops thereon toward brush 140. If the lollipops have not fallen into dial plate holes 112, brush 140, rotating counterclockwise (when viewed from motor side), continually throws the lollipops back until they fall into a hole 112. Lollipops which have fallen into a hole 112 pass under brush 140. The sticks of these lollipops stick out from the holes 112 and are thereby biased or bent inward toward the center of dial plate 110 by the force of the rotating brush 140. When the sticks of the lollipops move out from under the brush 140, the heads of the lollipops, riding on support ring 155, contact position roller 160. Position roller 160 rotates clockwise which thus rolls lollipop heads counterclockwise. As lollipop heads roll on position roller 160, lollipop sticks are moved towards stick grooves 113. Lollipops 50 then pass through an opening in dial plate divider 130. If the lollipop sticks have not settled into grooves 113, then the sticks hit stick guide 170 to bias the sticks into grooves 113.

With the sticks of the lollipops 50 positioned in stick grooves 113 and sticking straight out, the dial plate 110 moves the lollipops to transfer station 200. When each lollipop reaches the transfer point, a stick gripper 240 of gripper assembly 230 grabs the stick of the lollipop and lifts it from hole 112. Transfer station 200, rotating counterclockwise, moves the lollipop to the wrapping station 300. As this transfer is taking place, stick gripper 240 of gripper assembly 230 pivots about pivot 236. Accordingly, the lollipop is moved from a horizontal position to a vertical position.

When the vertically positioned lollipop reaches the wrapping station 300, gripper assembly 230 hands the lollipop over to the stick gripper and elevator assembly 350, rotating clockwise in unison with main shaft assembly 310, diaphragm assembly 370 and twister assembly 380. After gripping the lollipop stick, stick gripper and elevator assembly 350 begins to raise the lollipop toward diaphragm 370 and twister assembly 380 (see FIGS. 9A–9P). When the lollipop nears diaphragm 370, the paper feed assembly 400 feeds a piece of wrapping paper between the lollipop and diaphragm 370. The paper 60 becomes held in position against the lollipop by plunger 390 which descends downward through diaphragm 370. Stick gripper and elevator assembly 350 continues to raise the lollipop upward, until the head of the lollipop passes through diaphragm 370. As the lollipop passes through diaphragm 370, paper 60 is formed around the lollipop head. Twister fingers 382, having grippers 384, of the twister assembly 380, having opened as the lollipop was being raised, close around the head of the lollipop. The diaphragm 370 closes around the stick of the lollipop.

With the lollipop and wrapping material securely held by diaphragm 370 and twister assembly 380, stick gripper and elevator assembly 350 releases the lollipop and returns to its original position. Twister assembly 380 then twists the lollipop head and the paper 60 therearound, while the diaphragm 370 prevents the paper 60 around the stick of the lollipop from moving. As a result, the paper 60 around the lollipop receives a single twist (or multiple twists). The diaphragm assembly 370 simultaneously heat seals the twist to securely wrap the lollipop. At this point, the twister fingers 382 and diaphragm 370 open, plunger 390 descends, and the wrapped lollipop falls from wrapping station 300 into a storage bin or, alternatively, onto a conveyor belt to be moved to a packaging station.

The wrapping of lollipops by the invention 10 is one continuous process with each successive lollipop being oriented, transferred, wrapped and discharged. The invention 10 provides continuous motion and constant control of the lollipops at all times during feeding and transfers.

The invention 10 is designed for easy cleaning and maintenance. The automatic feeding and sorting hopper is easily detached for cleaning and washing. All controls are placed in watertight panels.

The paper feed assembly contains a paper saving device wherein in the unlikely event no lollipop is transferred to the wrapping station, no paper will be fed. The paper feed adjustments are easily accessible when a change of lollipop is required. An optional photo registration is available for the paper feeding device.

The present invention can be configured to wrap different diameter ball lollipops. For example, one embodiment of the invention could be configured to wrap 20/30 mm diameter ball lollipops. The invention could wrap such lollipops at a rate of approximately 300 per minute. Another embodiment of the invention could be configured to wrap 31/38 mm diameter ball lollipops at a rate of approximately 150 per minute.

While the assemblies of the wrapping station 300 are actuated by a system of cams, it is foreseen that other means such as solenoids could be used to selectively operate the assemblies of wrapping station 300.

It is to be understood that the embodiments herein described are merely illustrative of the principles of the present invention. Various modifications may be made by those skilled in the art without departing from the spirit or scope of the claims which follow.

I claim:

1. A wrapping machine comprising:

means for positioning a plurality of randomly orientated objects to be wrapped;

means for feeding said plurality of objects to said means for positioning;

means for wrapping said plurality of objects, said means for wrapping in proximity to said means for positioning;

means for transferring said plurality of objects from said means for positioning to said means for wrapping, said means for transferring in proximity to and cooperatively associating with said means for positioning and said means for wrapping;

means for feeding paper to said means for wrapping, said means for feeding paper in proximity to said means for wrapping;

at least one means for operatively driving said means for positioning, said means for transferring, said means for wrapping, and said means for feeding paper; and control means for selectively operating said wrapping machine;

said means for wrapping includes:

a main shaft assembly;

a gripper and elevator assembly rotatably mounted to said main shaft assembly for receiving one of said plurality of objects from said means for transferring;

a diaphragm assembly rotatably mounted in said main shaft assembly and being selectively openable and closeable; and a twister assembly rotatably mounted in said main shaft assembly.

2. A wrapping machine comprising:

means for positioning a plurality of randomly orientated objects to be wrapped;

means for feeding said plurality of objects to said means for positioning;

means for wrapping said plurality objects, said means for wrapping in proximity to said means for positioning;

means for transferring said plurality of objects from said means for positioning to said means for wrapping said means for transferring in proximity to and cooperatively associating with said means for positioning and said means for wrapping;

means for feeding paper to said means for wrapping, said means for feeding paper in proximity to said means for wrapping;

at least one means for operatively driving said means for positioning, said means for transferring, said means for wrapping, and said means for feeding paper; and control means for selectively operating said wrapping machine;

said means for feeding paper includes:

a paper arm assembly for holding a paper supply;

a gear box for operatively controlling said means for feeding paper;

a paper roller assembly for delivering said paper to said means for wrapping;

a paper transfer plate for temporarily supporting and guiding said paper to said means for wrapping; and a knife assembly for cutting said paper into a wrapper.

3. A wrapping machine comprising:

means for positioning a plurality of randomly orientated objects to be wrapped;

means for feeding said plurality of objects to said means for positioning;

means for wrapping said plurality of objects, said means for wrapping in proximity to said means for positioning;

means for transferring said plurality of objects from said means for positioning to said means for wrapping, said means for transferring in proximity to and cooperatively associating with said means for positioning and said means for wrapping;

means for feeding paper to said means for wrapping, said means for feeding paper in proximity to said means for wrapping;

at least one means for operatively driving said means for positioning, said means for transferring, said means for wrapping, and said means for feeding paper; and control means for selectively operating said wrapping machine;

said means for positioning said plurality of objects is an orienteering plate comprising:

a rotatable dial plate having a plurality of holes near an outside circumference thereof, each of said holes having a groove;

a rotatable spread plate having a conical surface and being concentric with said dial plate;

a support ring under said dial plate; and means for orienting said plurality of objects in said holes of said dial plate.

4. The machine of claim 3, wherein said means for orienting said plurality of objects includes a rotatable brush positioned over said dial plate, and a rotatable roller positioned under said dial plate, in an opening of said support ring.

5. The machine of claim 1, wherein said means for feeding said plurality of objects is a feeding and sorting hopper which delivers said plurality of objects directly on said means for positioning.

6. The machine of claim 5, wherein said feeding and sorting hopper comprises:

a support structure;

a bin for receiving said plurality of objects;

at least one channel for transferring said plurality of objects from said bin to said means for positioning; and at least one vibrator for providing motive force to said plurality of objects.

7. The machine of claim 1, wherein said means for driving includes at least one motor, and a main drive shaft.

8. The machine of claim 1, wherein said means for transferring comprises a rotatable plate and a plurality of gripper assemblies mounted to said rotatable plate, said gripper assemblies each having a gripper for receiving one of said plurality of objects from said means for positioning.

9. The machine of claim 8, wherein each of said gripper receives one of said plurality of objects in a horizontal position and pivots as said rotatable plate rotates to deliver said one of said plurality of objects to said means for wrapping in a vertical position.

10. The machine of claim 1, wherein said gripper and elevator assembly includes a guide body and a height adjuster arm assembly slidably mounted in said guide body, said height adjuster arm assembly comprising a shaft and an arm, said shaft sliding in said guide body to selectively move said one of said plurality of objects through said diaphragm assembly and into said twister assembly to be wrapped.

11. The machine of claim 10, wherein said arm of said height adjuster arm assembly includes:

a gripper for receiving said one of said plurality of objects from said means for transferring in a vertical position; and a support mechanism for supporting said one of said plurality of objects in said gripper, said support mechanism selectively pivotable under said one of said plurality of objects.

12. The machine of claim 1, wherein said diaphragm assembly includes a pair of claws pivotably operable to receive said one of said plurality of objects from said gripper and elevator assembly, and to hold said one of said plurality of objects during wrapping, said claws including a heating element for heat sealing a wrapper.

13. The machine of claim 1, wherein said twister assembly includes:

rotatable and pivotable twistfingers having grippers, said twistfingers pivoting to receive one of said plurality of objects and rotating to twist said one of said plurality of objects and a wrapper; and a plunger for holding said wrapper to a top portion of said one of said plurality of objects.

14. The machine of claim 13, wherein said means for feeding paper feeds a piece of paper between one of said plurality of objects and said plunger.

15. The machine of claim 1, wherein said plurality of objects are lollipops having a spherical head and a stick extending therefrom.

16. An apparatus for wrapping lollipops having an ellipsoidal head and a stick extending therefrom; said apparatus comprising:

a housing structure;

an orienteering plate rotatably mounted in said housing structure;

a wrapping station including a main shaft assembly, a plurality of stick grippers and elevator assemblies, a plurality of diaphragm assemblies and a plurality of twister assemblies;

a transfer station for transferring said lollipops from said orienteering plate to said wrapping station said transfer station including a plurality of gripper assemblies;

a paper feed assembly for supplying wrapping paper between said plurality of stick grippers and elevator assemblies and said plurality of diaphragm assemblies of said wrapping station;

drive means for driving said orienteering plate, said transfer station, said wrapping station, and said paper feed assembly; and control means for selectively operating said apparatus.

17. The apparatus of claim 16, further comprising a feeding and sorting hopper movably positioned next to said orienteering plate for holding a plurality of lollipops and delivering the lollipops to said orienteering plate, said feeding and sorting hopper includes a storage bin, a bin support, at least one feeding channel, and at least one vibrator for vibrating said feeding channel.

18. The apparatus of claim 16, wherein said orienteering plate comprises a dial plate, a conical spread plate concentric with said dial plate, a support ring positioned under said dial plate, a brush, and a positioning roller.

19. The apparatus of claim 18, wherein said dial plate has a plurality of holes for receiving said head of said lollipops, and a plurality of grooves extending partially into said dial plate for receiving said stick of said lollipops.

20. The apparatus of claim 19, wherein said plurality of gripper assemblies of said transfer station are mounted on a rotatable plate, said gripper assemblies operable to grip said stick of said lollipops and lift said lollipops from said orienteering plate and deliver said lollipops to said stick grippers and elevator assemblies of said of said wrapping station, said gripper assemblies of said transfer station being pivotable to grasp said stick in a horizontal position and deliver said stick in a vertical position.

21. The apparatus of claim 20, wherein said stick gripper and elevator assemblies receive said stick of said lollipops from said gripper assemblies of said transfer station and elevate to lift said lollipops through said diaphragm assemblies and into said twister assemblies.

22. The apparatus of claim 21, wherein said diaphragm assemblies include two claws pivotable to close around said stick of said lollipop and said wrapping paper, and said twister assemblies include two twistfingers pivotable to close around said head of said lollipop and said wrapping paper and rotatable to twist said head of said lollipop and said wrapping paper, said diaphragm assemblies and said twister assemblies cooperate to wrap said lollipops.

23. A method of wrapping lollipops having ellipsoidal heads and sticks comprising the sequential and continuous steps of:

delivering a plurality of randomly positioned lollipops from a feeding and sorting hopper to an orienteering plate;

orienting said lollipops on an orienteering plate having a dial plate with a plurality of holes and stick grooves, said lollipops being oriented with said spherical heads in said holes and said sticks in said stick grooves;

transferring said lollipops from said orienteering plate to a wrapping station having a plurality of stick gripper and elevator assemblies, diaphragm assemblies, and twister assemblies, via a transfer station having a plurality of gripper assemblies;

feeding wrapping paper from a paper feed assembly to said wrapping station between said stick gripper and elevator assemblies and said diaphragm assemblies;

wrapping said lollipops; and discharging said lollipops from said wrapping station.

24. The method of claim 23, wherein said step of transferring includes the steps of:

gripping said sticks of said lollipops with said gripper assemblies;

lifting said lollipops from said orienteering plate;

rotating said gripper assemblies to said stick gripper and elevator assemblies of said wrapping station; and pivoting said gripper assemblies during rotation to reposition said lollipops from a horizontal position to a vertical position.

25. The method of claim 23, wherein the step of wrapping includes the steps of:

gripping said sticks of said lollipops with said stick gripper and elevator assemblies;

raising said lollipops through said diaphragm assemblies and into said twister assemblies;

closing said diaphragm assemblies around said sticks of said lollipops and said wrapping paper;

closing said twister assemblies around said heads of said lollipops and said wrapping paper; and rotating said twister assemblies to wrap said lollipops.

26. A wrapping station for wrapping a plurality of objects in sequence, said wrapping station comprising:

a main shaft assembly;

a gripper and elevator assembly rotatably mounted to said main shaft assembly;

a diaphragm assembly rotatably mounted in said main shaft assembly;

a twister assembly rotatably and rotationally mounted in said main shaft assembly; and means for driving said main shaft assembly;

said gripper and elevator assembly includes a guide body and a height adjuster arm assembly slidably mounted in said guide body, said height adjuster arm assembly comprising a shaft and an arm, said shaft sliding in said guide body to selectively move said one of said plurality of objects through said diaphragm assembly and into said twister assembly to be wrapped;

said diaphragm assembly includes a pair of claws pivotably operable to receive said one of said plurality of objects from said gripper and elevator assembly, and to hold said one of said plurality of objects during wrapping, said claws including a heating element for heat sealing a wrapper;

said twister assembly including:

rotatable and pivotable twistfingers having grippers, said twistfingers pivoting to receive one of said plurality of objects and rotating to twist said one of said plurality of objects and a wrapper; and a plunger for holding said wrapper to a top portion of said one of said plurality of objects.

27. The machine of claim 1, wherein said means for wrapping and said means for transferring have both rotational and non-rotational movement said non-rotational movement effectuated via a system of cams.

28. The machine of claim 9, wherein said gripper is openable and closable and pivotable via a system of cams.

29. The machine of claim 11, wherein said gripper is openable and closeable, said support mechanism is pivotable, and said height adjuster arm assembly is slidable in said guide body via a system of cams.

30. The apparatus of claim 16, wherein said stick grippers and elevator assemblies of said wrapping station and said gripper assemblies of said transfer station have both rotational and non-rotational movement, said non-rotational movement effectuated via a system of cams.

31. The apparatus of claim 18, wherein said support ring includes an opening and a notch, said positioning roller pivotably mounted in said opening of said support ring, said notch located after said transfer station and positioned under said holes in said dial plate to allow said lollipops to fall through said holes upon passing by said transfer station.

* * * * *